US010232606B2

(12) United States Patent
Namiki et al.

(10) Patent No.: US 10,232,606 B2
(45) Date of Patent: Mar. 19, 2019

(54) PRINTING DEVICE AND PRINTING METHOD

(71) Applicant: MIMAKI ENGINEERING CO., LTD., Nagano (JP)

(72) Inventors: Takashi Namiki, Nagano (JP); Kazuhiro Ochi, Nagano (JP); Eiichi Ohara, Nagano (JP); Sota Machii, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/312,179

(22) PCT Filed: May 14, 2015

(86) PCT No.: PCT/JP2015/063851
§ 371 (c)(1),
(2) Date: Nov. 17, 2016

(87) PCT Pub. No.: WO2015/178280
PCT Pub. Date: Nov. 26, 2015

(65) Prior Publication Data

US 2017/0100928 A1 Apr. 13, 2017

(30) Foreign Application Priority Data

May 19, 2014 (JP) ..... 2014-103721
Oct. 29, 2014 (JP) ..... 2014-220683

(51) Int. Cl.
*B41J 2/045* (2006.01)
*B41J 2/21* (2006.01)
*B41J 2/01* (2006.01)

(52) U.S. Cl.
CPC ..... *B41J 2/04508* (2013.01); *B41J 2/01* (2013.01); *B41J 2/04586* (2013.01); *B41J 2/21* (2013.01)

(58) Field of Classification Search
CPC ..... B41J 2/2117; B41J 2/21; B41J 2/2114; C09D 11/40
See application file for complete search history.

(56) References Cited

U.S. PATENT DOCUMENTS

2001/0031352 A1* 10/2001 Yamamori ..... B05D 5/067 428/324
2010/0053247 A1 3/2010 Kakutani
(Continued)

FOREIGN PATENT DOCUMENTS

JP 2001-246767 9/2001
JP 2010-274532 12/2010
(Continued)

OTHER PUBLICATIONS

"International Search Report (Form PCT/ISA/210) of PCT/JP2015/063851", dated Aug. 11, 2015, with English translation thereof, pp. 1-4.
(Continued)

*Primary Examiner* — John P Zimmermann
(74) *Attorney, Agent, or Firm* — JCIPRNET

(57) ABSTRACT

A printing device prints an object on a medium by inkjet printing. The printing device includes: a glossy ink head that discharges ink droplets of a glossy ink having a glossy color; and a main scan driver that prompts the glossy ink head to perform main scans in which the glossy ink head discharges the ink droplets while moving in a predetermined main scanning direction. The glossy ink contains a glossy pigment and a solvent. In the main scans, the glossy ink head discharges the ink droplets plural times while moving in the main scanning direction to form ink dots at positions on the
(Continued)

medium aligned in the main scanning direction. The ink droplets discharged from the glossy ink head each have a volume constituting a size that allows for contact on the medium between any ones of dots formed in each one of the main scans.

15 Claims, 18 Drawing Sheets

(56) References Cited

U.S. PATENT DOCUMENTS

2012/0019579 A1 1/2012 Usuda et al.
2012/0052261 A1* 3/2012 Aoyama ..... B41M 5/0011 428/195.1
2012/0169803 A1 7/2012 Takamura
2012/0174824 A1* 7/2012 Takenaka ..... B22F 1/0055 106/404
2012/0249668 A1* 10/2012 Denda ..... B41M 5/0023 347/20
2012/0287200 A1* 11/2012 Yano ..... C09D 11/101 347/20
2013/0286069 A1* 10/2013 Aoyama ..... B41J 2/21 347/9
2014/0043386 A1* 2/2014 Saita ..... B41J 11/002 347/15
2016/0016402 A1* 1/2016 Denda ..... B41J 2/21 347/15

FOREIGN PATENT DOCUMENTS

JP 2011-218564 11/2011
JP 2012040703 3/2012
JP 2012040865 3/2012
JP 2012139940 7/2012

OTHER PUBLICATIONS

"Office Action of China Counterpart Application," with English translation thereof, dated Jun. 28, 2017, p. 1-p. 19, in which the listed references were cited.
"Search Report of Europe Counterpart Application", dated Oct. 10, 2017, p. 1-p. 7, in which the listed reference was cited.
"Office Action of Japan Counterpart Application" dated Apr. 3, 2018, with English translation thereof, p. 1-p. 17.

* cited by examiner

Fixed conditions
Ink for evaluation: Me36-6-②
Medium for evaluation: SPC-0706
Heater temperature: 40/40/50°C
Unidirectional, normal printing
Logical seek ON (scan width: approximately 100 mm)
Mask: default (staggered)

| Waveform | Dot size | Dot gain (μm) | | Shot Volume (ng) |
|---|---|---|---|---|
| | | Y direction | X direction | |
| WF6 | S | 61.85 | 59.08 | 5.45 |
| | M | 78.00 | 73.84 | 11.67 |
| | L | 93.23 | 84.92 | 19.44 |
| WF8 | S | 53.54 | 46.62 | 4.22 |
| | M | 59.07 | 51.69 | 5.53 |
| | L | 73.84 | 71.08 | 14.28 |

FIG. 3

720x720_4pass_100%
WF8_Ldot

Inter-dot distance in X direction: 35.28 μm

Inter-dot distance in Y direction: 35.28 μm

1440x720_8pass_50%
(Staggered arrangement) / WF8_Ldot

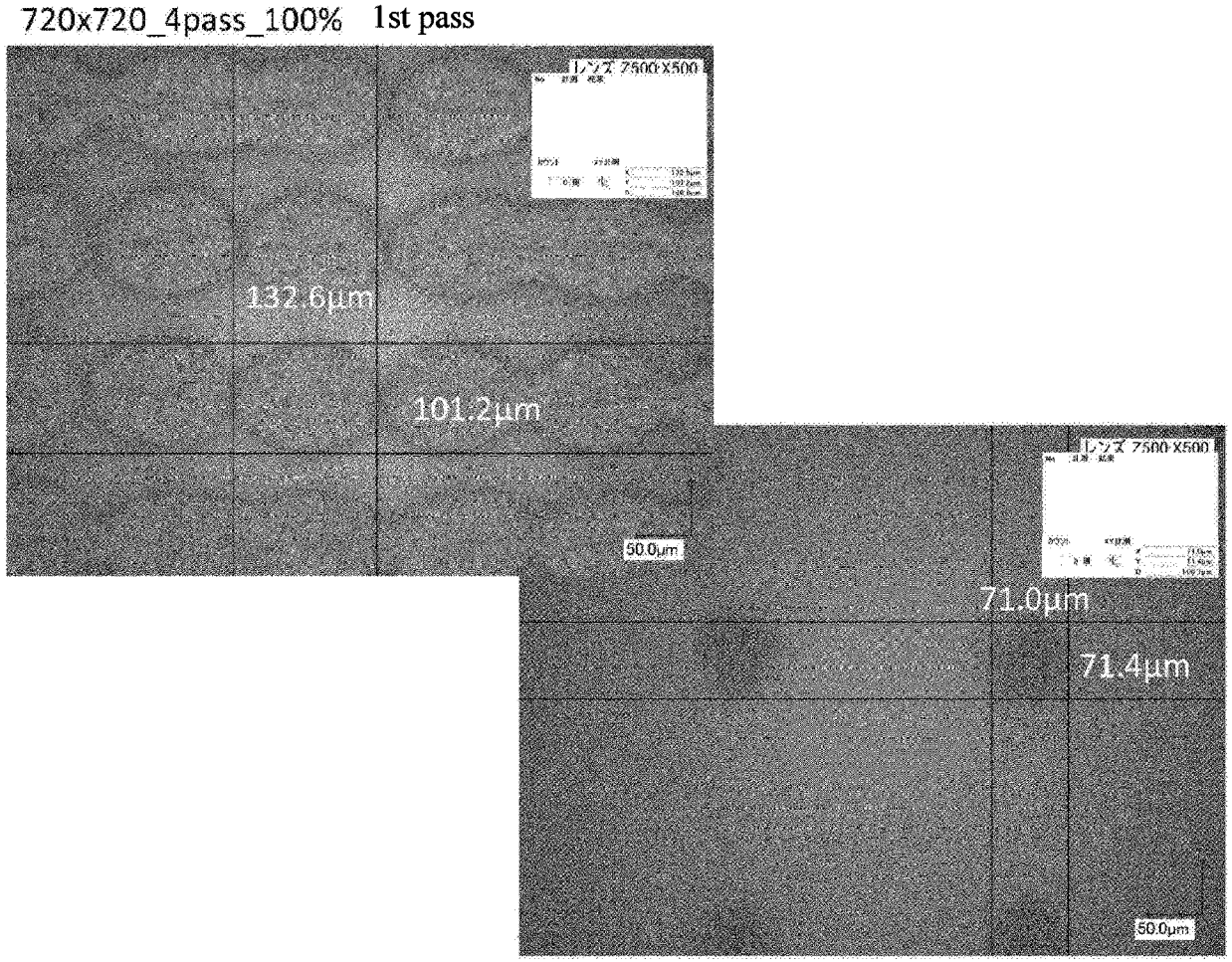
FIG. 8 Dot gain (360x360_2pass_6.25%)

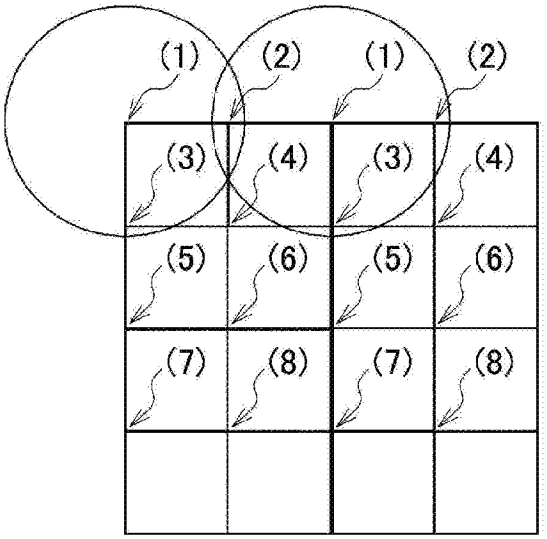
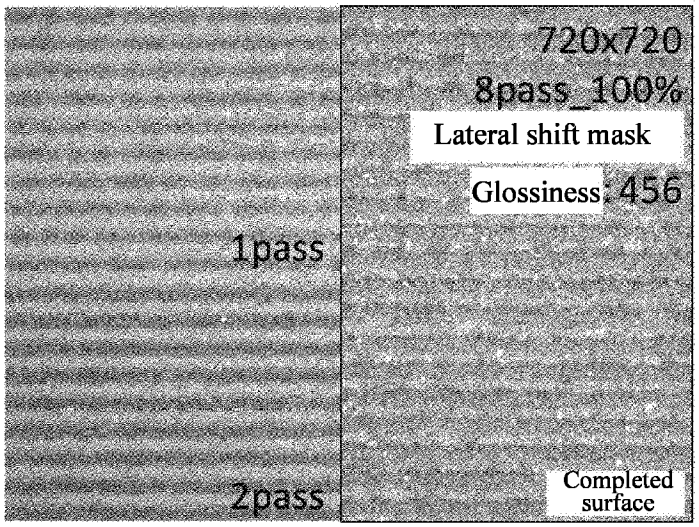
FIG. 11

| Waveform | Dot size | Dot gain (μm) | | Shot Volume (ng) | |
|---|---|---|---|---|---|
| | | Y direction | X direction | | |
| WF6 | S | 61.85 | 59.08 | 5.45 | 1440x720_16pass |
| | M | 78.00 | 73.84 | 11.67 | |
| | L | 93.23 | 84.92 | 19.44 | |
| WF8 | S | 53.54 | 46.62 | 4.22 | 1440x720_8pass |
| | M | 59.07 | 51.69 | 5.53 | |
| | L | 73.84 | 71.08 | 14.28 | |

Condition A ・720x720_8pas_Bi/Hi Ldot 100%
Glossiness : 500

Condition B ・1440x720_8pas_Bi/Nor S/L-50%/50%
Glossiness : 560

Condition C ・1440x720_16pas_Bi/Nor S/L-50%/50% (WF6)
Glossiness : 520

Other conditions
Ink for evaluation: Me36-6-②
Medium for evaluation: Glossy white polyvinyl chloride SPC-0706
Heater temperature: 40/40/50°C
Waveform: SS21_W/WF8,WF6
Logical seek OFF
(scan width: approximately 1300 mm)
Lateral shift mask

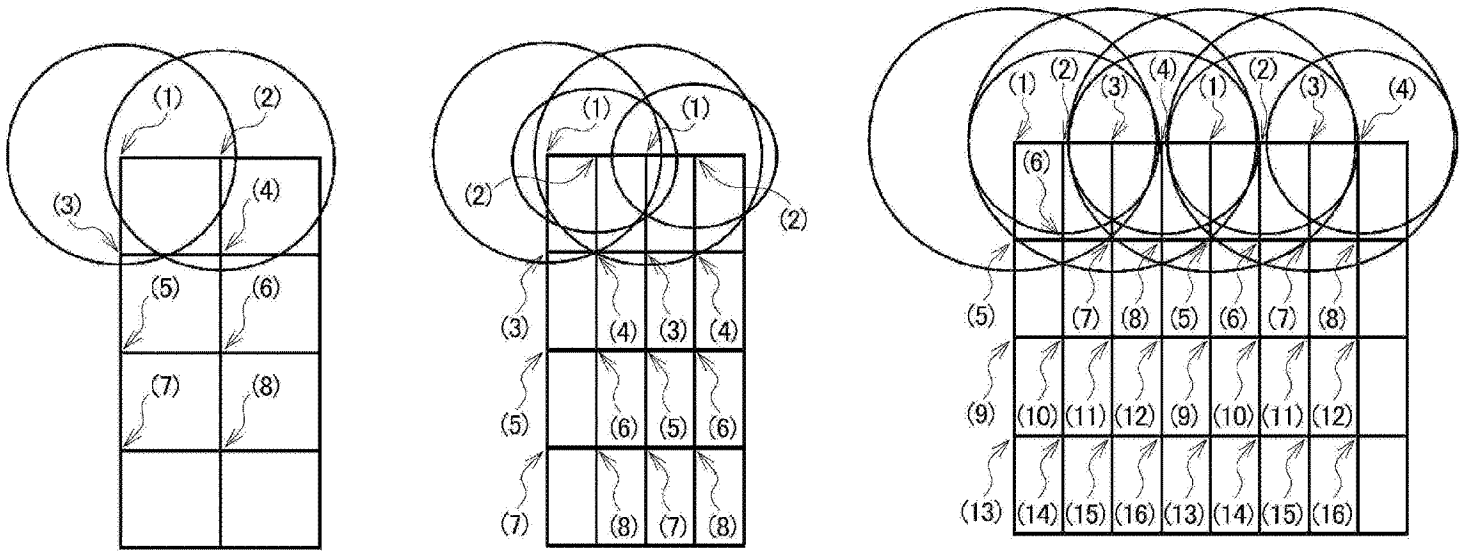

Condition A Condition B Condition C

FIG. 14

Per-Lv division number
| | Lv1 | Lv2 | Lv3 | Lv4 | Lv8 |
|---|---|---|---|---|---|
| Head division number | 3 | 4 | 5 | 6 | 10 |
FIG. 16A
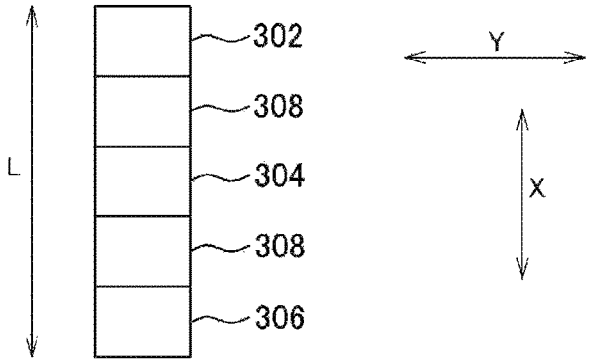
FIG. 16B
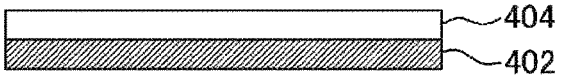
FIG. 16C

| Color | | Silver |
|---|---|---|
| Viscosity (20rpm) mPa·s | 25°C | 2.92 |
| Surface tension mN/m | Wilhelmy | 29.3 |
| Contact angle ° (water-repellent surface) | Static | 62.0° |
| Dot diameter μm ( Platen : 40°C) (Medium: GPVC) | S<br>M<br>L | 53.8<br>72.5<br>91.5 |
| Solid content | | 0.80% |

PRINTING DEVICE AND PRINTING METHOD

CROSS-REFERENCE TO RELATED APPLICATION

This application is a 371 application of the International PCT application Ser. No. PCT/JP2015/063851, filed on May 14, 2015, which claims the priority benefits of Japan Patent Application No. 2014-103721, filed on May 19, 2014 and Japan Patent Application No. 2014-22068 , filed on Oct. 29, 2014. The entirety of each of the above-mentioned patent applications is hereby incorporated by reference herein and made a part of this specification.

TECHNICAL FIELD

This disclosure relates to a printing device and a printing method.

BACKGROUND ART

Conventionally, ink jet printers are used in a broad range of industrial and technical fields (for example, patent literature 1). Inks conventionally used in the ink jet printers may include, as well as the C, M, Y, and K inks for color printing inks, a variety of other inks that impart distinctive features to printed matters. Examples of such inks may include glossy color inks such as inks having metallic colors (for example, metallic inks).

CITATION LIST

Patent Literature

Patent Literature 1: Japanese Unexamined Patent Publication No. 2012-40703

SUMMARY OF DISCLOSURE

Technical Problems

The glossy inks typically used may contain light-reflecting pigments. Even when such an ink is used, a printed matter obtained may not be as glossy as expected under certain printing conditions. Taking a silver color metallic ink for instance, a printed matter obtained may result in poor glossiness under certain printing conditions, appearing as if it were printed with a simple gray color ink. An effective solution that promises desired glossiness in printed matters printed with glossy color inks, therefore, has so far been strived for. This disclosure provides a printing device and a printing method that may overcome the issue described above.

Solutions to the Problems

The inventors of this application studied on and searched for printing conditions that could maximize the glossiness of printed matters printed with glossy inks such as metallic inks. The inventors' study led them to the finding that the glossiness of a printed matter was affected by variability of distances between ink dots (dot intervals) formed on a medium. They set the dot intervals to different values while having the ink droplet discharged in a constant volume from an ink jet head. This test revealed that the dot intervals greater than a certain distance could incur poor glossiness.

The inventors further studied on this issue and learnt the facts described below. The certain distance mentioned above is substantially a distance small enough to bring the ink dots into mutual contact on the medium, indicating that high glossiness is attainable when the ink dots are spaced at very close intervals that allow for contact between them. On the other hand, high glossiness is unlikely to be attainable when the ink dots are spaced at intervals too large to allow for contact therebetween, because whether the pigments are fixated well to the medium depends on variability of the inter-dot distance.

For example, a pigment contained in an ink is fixated to a medium by evaporating a solvent contained in the ink (for example, organic solvent). In this instance, the inventors of this application learnt the importance of investing adequately long time to volatilize and strip the solvent in order to successfully fixate the pigment while attaining expected glossiness.

This may be important because the pigment fixated to the medium may be more disorderly oriented as the solvent is volatilized and stripped more quickly. Such disorderly orientation of the pigment may increase the likelihood that light reflected by the fixated ink randomly scatters, possibly degrading the glossiness. On the other hand, the pigment is expected to be more orderly fixated to the medium by investing sufficiently long time to volatilize and strip the solvent. The orderly fixated pigment means that scaly particles of the pigment are fixated to the medium like scales (two-dimensionally). Once the pigment is thus fixated, the pigment fixated to the medium may be more orderly orientated. This may reduce the possibility of light reflected by the fixated ink scattering around, promising higher glossiness.

On the medium, it conventionally takes more time to volatilize and strip the solvent as an ink forming the ink dots is greater in volume, because a greater volume of ink may have a surface area relatively small to its volume because of the ink's surface tension.

With no contact between the ink dots on the medium, the volume of each ink dot on the medium equals to the volume of one ink droplet discharged from the ink jet head. In that case, it takes less time to volatilize and strip the solvent from the ink dot, posing the risk of glossiness being degraded.

When the dot intervals are small enough to bring the ink dots into mutual contact on the medium, plural ink dots in contact are consequently merged into one larger ink dot. The resulting ink volume, therefore, equals to the total volume of separate ink dots unmerged. Then, more time is required to volatilize and strip the solvent from this ink dot than the time required for each one of the unmerged dots. Such a prolonged period of time for the solvent to be volatilized and stripped is considered to contribute to higher glossiness.

The inventors of this application, based on this finding, finally accomplished the technical aspects disclosed herein leading to improved glossiness. To address the conventional issue, this disclosure provides for the following technical aspects.

[Aspect 1] A printing device is provided that prints an object on a medium by inkjet printing. The printing device includes: a glossy ink head as an ink jet head that discharges ink droplets of a glossy ink having a glossy color; and a main scan driver that prompts the glossy ink head to perform main scans in which the glossy ink head discharges the ink droplets while moving in a main scanning direction previously set. The glossy ink contains a glossy pigment and a solvent. In the main scans, the glossy ink head discharges the ink droplets plural times while moving in the main scanning direction to form ink dots at a plurality of positions on the medium aligned in the main scanning direction. The ink droplets discharged from the glossy ink head each have a volume constituting a size that allows for contact on the medium between any ones of the ink dots formed in each one of the main scans.

In the printing device according to this aspect, the dots of the glossy ink are merged on the medium into dots greater in size. This may require more time to volatilize and strip the solvent. Further, the glossy ink fixated to the medium may result in a very glossy appearance. According to this aspect, therefore, the glossy ink fixated to the medium may attain excellent glossiness.

The contact on the medium between the ink dots formed in each main scan may be rephrased as contact between contiguous ones of the ink dots in the main scanning direction. The contact between the ink dots on the medium may be rephrased as contact between the ink dots in liquid state before the solvent is volatilized and stripped from the ink dots. The contact between the liquid ink dots may be rephrased as contact between the ink dots that allow them to be merged into one dot. The volume of an ink droplet may be a designed volume.

The glossy ink may contain a light-reflecting pigment including scaly particles. The glossy ink may be a metallic color ink or a pearl color ink. The solvent contained in the glossy ink may be an organic solvent. The organic solvent may be a volatile organic solvent.

The glossy ink head may have a nozzle array having a plurality of nozzles aligned in a row in a sub scanning direction orthogonal to the main scanning direction. In each one of the main scans, the glossy ink head discharges the ink droplets through the nozzles of the nozzle array. By having the ink droplets thus discharged, the ink dots arranged in the sub scanning direction are formed on the medium in positional alignment with one another in the main scanning direction. In this instance, the ink droplets discharged from the glossy ink head may each preferably have a volume constituting a size that allows for contact on the medium between any ones of the ink dots formed in the sub scanning direction in positional alignment with one another in the main scanning direction.

[Aspect 2] The glossy ink is a metallic color ink. The metallic color ink may be a silver color ink. The silver color ink may contain a pigment made of a metal, for example, aluminum. This metallic pigment may contain scaly particles.

When, for example, the metallic ink is used as the glossy ink, glossiness is desirably attained as evenly as possible. To this end, any orientational randomness of the pigment fixated to the medium is desirably suppressed. The aspect of this disclosure may ensure that adequately long time is invested to volatize and strip the solvent from the glossy ink on the medium. As a result, the metallic ink may attain excellent glossiness.

[Aspect 3] The printing device further includes a color ink head as an ink jet head that discharges ink droplets of a color printing ink. An ink dot formed on the medium by an ink droplet discharged from the color ink head is smaller in size than an ink dot formed on the medium by an ink droplet discharged from the glossy ink head.

The ink dot size may refer to the diameter of an ink dot. The ink dot diameter may be a designed diameter. The color printing ink may be an ink for image formation. Examples of the color printing ink may include the C, M, Y, and K color inks. Preferably, the ink droplets of the color printing ink may each have a volume small enough to avoid any contact between the ink dots on the medium. Avoidance of contact between the ink dots on the medium may be rephrased as avoidance of contact between the ink dots formed at different pixel positions. According to this aspect, color printing may be successfully effectuated as well as the glossy ink printing.

For high-resolution printing using the color printing inks, such as the C, M, Y, and K inks, the ink dots formed on the medium need to be adequately small in size. According to this aspect, the dots of the color printing ink may be adequately reduced in size, and high-resolution printing may be successfully effectuated.

When the color printing ink is used to print an object, any contact between the ink dots on the medium may result in a degraded printing quality. In the case of any contact between the ink dots in different colors, the colors are likely to bleed into each other, degrading the printing quality. By forming a smaller ink dot using an ink droplet of the color printing ink, any contact between the ink dots on the medium may be effectively prevented. This may further ensure high-quality printing.

The color printing ink to be used may further include light color inks (for example, light magenta or light cyan), or may further include other color inks depending on a demanded printing quality.

[Aspect 4] The printing device further includes a drive signal output unit that outputs a drive signal to prompt the ink droplets to be discharged. The drive signal output unit outputs a first drive signal to the color ink head, the first drive signal being a signal that changes in a first waveform previously set, and outputs a second drive signal to the glossy ink head, the second drive signal being a signal that changes in a waveform different from the first waveform of the first drive signal. The second drive signal drives the ink droplets to be discharged in a greater volume than the first drive signal.

This may adequately regulate the ink droplet volumes of the glossy ink and the color printing ink. For both of the glossy ink and the color printing ink, therefore, the ink dot size formed by an ink droplet may be adjusted to a suitable size.

[Aspect 5] The glossy ink is more readily spreadable on the medium than the color printing ink. This may facilitate the setting of conditions that allow for contact on the medium between the ink dots of the glossy ink. Then, the glossy ink fixated to the medium may result in high glossiness.

Assuming that the same drive signal is used for the color ink head and the glossy ink head, the ink dot formed by an ink droplet of the glossy ink thus characterized may be greater in size than the ink dot formed by an ink droplet of the color printing ink. For both of the glossy ink and the color printing ink, therefore, the ink dot size formed by an ink droplet may be adjusted to a more suitable size.

[Aspect 6] The printing device prints an object by multipass printing. In each one of the main scans, the glossy ink head discharges the ink droplets to pixel positions selected based on mask data previously set. The ink droplets discharged from the glossy ink head each have a volume constituting a size that allows for contact on the medium between the ink dots formed in each one of the main scans. Printing an object in multiple passes may facilitate high-resolution printing and high glossiness of the glossy ink.

When an object is printed in multiple passes, the ink droplets of the glossy ink are discharged to at least alternate ones of pixel positions in the main scanning direction. In this instance, alternate ones of pixel positions in the main scanning direction may be specifically alternate ones of pixel positions in the main scanning direction among the pixel positions arranged suitably set for a demanded printing resolution. More specifically, alternate ones of pixel positions in the main scanning direction may be positions spaced at an interval equal to a distance twice as large as a printing resolution pitch in the main scanning direction. The ink droplet having a volume constituting a size that allows for contact on the medium between the ink dots formed in each one of the main scans may be rephrased as the ink droplet having a volume that allows the dot formed by an ink droplet to have a diameter at least twice or more than twice of the resolution pitch in the main scanning direction.

[Aspect 7] The printing device further includes another color ink head as an ink jet head that discharges ink droplets of a color printing ink. The color ink head discharges the ink droplets to pixel positions selected based on one piece of the mask data shared with the glossy ink head. The ink droplets discharged from the color ink head each have a volume constituting a size that allows for no contact on the medium between the ink dots formed in each one of the main scans. No contact on the medium between the dots formed in each one of the main scans may be rephrased as no contact between the ink dots formed at different pixel positions.

Printing an object in multiple passes using the color ink head may facilitate high-resolution color printing. Using the same mask data for the color ink head and the glossy ink head may enable the multipass printing without overly complicating the operation control.

By discharging the ink droplets from the color ink head in a volume that allows for no contact between the ink dots on the medium, different colors may be prevented from bleeding into each other. This may further facilitate high-resolution color printing.

[Aspect 8] In the printing device, the glossy ink head has a glossy ink nozzle through which the ink droplets of the glossy ink are discharged, and the printing device has a color printing nozzle through which the ink droplets of the color printing ink are discharged. The main scan driver prompts the glossy ink nozzle and the color printing nozzle to discharge the ink droplets in the main scans. When the density of the ink dots formed on the medium by one nozzle in a preset number of the main scans is defined as a main scan dot density, the main scan driver prompts the glossy ink nozzle to form the ink dots at a first main scan dot density, and prompts the color printing nozzle to form the ink dots at a second main scan dot density lower than the first main scan dot density.

According to this aspect, the glossy ink dots may be formed at the first main scan dot density higher than the other. This may facilitate the setting of conditions that allow for contact between the ink dots on the medium. The color printing ink dots may be formed at the second main scan dot density lower than the other. This may facilitate the setting of conditions that allow for no contact between the ink dots on the medium. This aspect, therefore, may effectively prevent color bleeding between the color printing inks, while successfully attaining high glossiness of the glossy ink. Further favorably, the glossy ink may attain even higher glossiness without compromising a desirable image quality to be achieved by the color printing ink.

The main scan dot density may refer to the density of target pixels for which the ink droplets are discharged in a predetermined number of main scans. The density of target pixels for which the ink droplets are discharged may represent a ratio of target pixels for which the ink droplets are discharged in the main scans to pixels arranged suitably set for a demanded printing resolution. More specifically density of target pixels for which the ink droplets are discharged may represent a ratio of target pixels for which the ink droplets are discharged to pixels included in a certain area. The density of target pixels for which the ink droplets are discharged may be rephrased as a recording duty or a recording density in a predetermined number of main scans.

The main scan dot density may be more specifically an ink dot density in one main scan, or an ink dot density in a preset number of main scans. In connection with the main scan dot density by a plurality of main scans, the main scans by the glossy ink nozzle are performed within a time frame short enough to avoid full cure of the ink dots formed in the first main scan. Then, the ink dots formed in different ones of the main scans may also be successfully merged into one another.

[Aspect 9] The first main scan dot density is a main scan dot density that allows for contact on the medium between any ones of the ink dots of the glossy ink, and the second main scan dot density is a main scan dot density that allows for no contact on the medium between any ones of the ink dots of the color printing ink.

According to this aspect, the glossy ink may attain excellent glossiness. This aspect may also effectively prevent color bleeding between the color printing inks. As a result, the glossy ink may attain even higher glossiness without compromising a desirable image quality to be achieved by the color printing ink.

[Aspect 10] The printing device prints an object by multipass printing based on mask data that designates target pixels for which the ink droplets are discharged in each one of the main scans. The main scan driver uses different pieces of the mask data respectively for the glossy ink nozzle and for the color printing nozzle so as to have the first main scan dot density and the second main scan dot density differ from each other.

The first main scan dot density and the second main scan dot density may be accordingly set to suitable values. Further favorably, the glossy ink may attain even higher glossiness without compromising a desirable image quality to be achieved by the color printing ink.

[Aspect 11] When a printing pass number required for solid-color print of a preset region at a preset concentration is defined as a solid print pass number, the main scan driver uses mask data for the glossy ink nozzle and the color printing nozzle, the mask data being configured to set a smaller value for the solid print pass number when the solid-color print is performed by the glossy ink nozzle than for the solid print pass number when the solid-color print is performed by the color printing nozzle.

According to this aspect, the ink dots may be favorably formed by the glossy ink nozzle and the color printing nozzle based on the printing pass numbers respectively suitable for the first main scan dot density and the second main scan dot density. This may further improve the printing performances using the glossy ink nozzle and the color printing nozzle.

[Aspect 12] The printing device further includes a sub scan driver that prompts the glossy ink head to perform sub scans in which the glossy ink head moves relative to the medium in a sub scanning direction orthogonal to the main scanning direction. The glossy ink head has a plurality of glossy ink nozzles aligned in a row in the sub scanning direction. The main scan driver prompts at least a middle one in the row of the glossy ink nozzles to form the ink dots at the first main scan dot density. The main scan driver prompts at least an endmost one in the row of the glossy ink nozzles to form the ink dots at a third main scan dot density lower than the first main scan dot density.

When the main scans are plurally performed repeatedly as in the multipass printing method, a print result may exhibit the signs of banding. In the case where the banding occurs, a boundary between target regions to be printed in the respective main scans may noticeably stand out. The banding may result in a poor printing quality.

This aspect may allow a lower main scan dot density to be set for the boundary between target regions to be printed with the glossy ink in respective ones of the main scans. By setting the lower density at the boundary, the boundary may be less noticeable, effectively suppressing the occurrence of banding. This aspect, therefore, may attain excellent glossiness, while suppressing the occurrence of banding.

The sub scan driver prompts the glossy ink head to perform the sub scans by transporting the medium. At least an endmost side in the row of the glossy ink nozzles may be at least one end on the upstream or downstream side in the transport direction of the medium. The sub scan driver may instead move the glossy ink head to prompt the glossy ink head to perform the sub scans.

[Aspect 13] The color printing nozzle discharges the ink droplets on an ink layer formed by the glossy ink nozzle. According to this aspect, color printing that imparts glossiness may be successfully effectuated (for example, metallic color printing).

As described in this aspect, the ink droplets of another ink (color printing ink) are discharged on the glossy layer. In the case where the ink droplets are discharged in an overly abundant volume at a time at the main scan dot density relatively high, however, the glossy ink may possibly be tainted with the ink discharged later. This may result in a poor printing quality.

To avoid that, a lower density is set as the main scan dot intensity of the color printing. Then, intermingling of the color printing ink and the glossy ink may be less likely, preventing the printing quality from degrading.

In this aspect, the dots of the glossy ink formed on a lower layer may preferably be smaller in size than the dots of the color printing ink formed on an upper layer. This may effectively prevent the color printing ink from penetrating into the glossy ink. Further favorably, an object may be successfully printed with the color printing inks and the glossy ink even at a high resolution.

[Aspect 14] A printing method of printing an object on a medium by inkjet printing is provided. The printing method includes: prompting a glossy ink head as an ink jet head that discharges ink droplets of a glossy ink having a glossy color to perform main scans in which the glossy ink head discharges the ink droplets while moving in a main scanning direction previously set. The glossy ink contains a glossy pigment and a solvent. In the main scans, the glossy ink head discharges the ink droplets plural times while moving in the main scanning direction to form ink dots at a plurality of positions on the medium aligned in the main scanning direction. The ink droplets discharged from the glossy ink head each have a volume constituting a size that allows for contact on the medium between any ones of dots formed in each one of the main scans. This printing method may produce technical effects similar to the aspect 1.

[Aspect 15] A printing device is provided that prints an object on a medium by inkjet printing. The printing device includes: a glossy ink head as an ink jet head that discharges ink droplets of a glossy ink having a glossy color; and a main scan driver that prompts the glossy ink head to perform main scans in which the glossy ink head discharges the ink droplets while moving in a main scanning direction previously set. The glossy ink head has a glossy ink nozzle through which the ink droplets of the glossy ink are discharged. The main scan driver prompts the glossy ink nozzle to discharge the ink droplets in the main scans. When the density of ink dots formed on the medium by one nozzle in a preset number of the main scans is defined as a main scan dot density, the ink dots formed by the glossy ink nozzle have a main scan dot density that allows for contact on the medium between any ones of the dots and any other ones of the dots in liquid state that are formed in each one of the main scans.

The contact between the liquid dots of the glossy ink may suggest contact between the dots formed in plural ones of the main scans. The plural liquid dots thus brought into mutual contact may be consequently merged into one another. According to this aspect, therefore, excellent glossiness may be attained by the glossy ink.

[Aspect 16] A printing method of printing an object on a medium by inkjet printing is provided. The printing method includes: prompting a glossy ink head as an ink jet head that discharges ink droplets of a glossy ink having a glossy color to perform main scans in which the glossy ink head discharges the ink droplets while moving in a main scanning direction previously set. The glossy ink head has a glossy ink nozzle through which the ink droplets of the glossy ink are discharged. In the main scans, the glossy ink head discharges the ink droplets through the glossy ink nozzle. When the density of ink dots formed on the medium by one nozzle in a preset number of the main scans is defined as a main scan dot density, the ink dots formed by the glossy ink nozzle have a main scan dot density that allows for contact on the medium between any ones of the dots and any other ones of the dots in liquid state that are formed in each one of the main scans. This printing method may produce technical effects similar to the aspect 15.

[Aspect 17] A printing device is provided that prints an object on a medium by inkjet printing. The printing device includes: at least one or more ink jet heads; and a main scan driver that prompts the at least one or more ink jet heads to perform main scans in which the at least one or more ink jet heads discharge the ink droplets while moving in a main scanning direction previously set. The at least one or more ink jet heads have: a solid print nozzle through which ink droplets of an ink for solid-color print of a preset region are discharged; and a color printing nozzle through which ink droplets of a color printing ink are discharged. When the density of ink dots formed on the medium by one nozzle in a preset number of the main scans is defined as a main scan dot density, the main scan driver prompts the solid print nozzle to form ink dots at a first main scan dot density, and prompts the color printing nozzle to form the ink dots at a second main scan dot density lower than the first main scan dot density.

In the inkjet printing, a variety of inks may be used to solid-color print a preset region (solid-color print ink). The solid-color print of a preset region may be rephrased as discharging ink droplets at a concentration preset in the printing device (for example, 100% concentration). The preset concentration may be a concentration at which the ink droplets are discharged to all of pixel positions that are set suitably for a demanded printing resolution.

Examples of the solid-color print ink used to solid-color print a particular region may include glossy inks such as metallic inks, and clear color inks having transparency to light (clear inks). Any suitable inks having certain colors, for example, a white ink, may be used as the solid-color print ink. The main scan dot density of the solid-color print ink is desirably set to a sufficiently high density. This may ensure that a certain region is more uniformly solid-color printed.

To prevent the occurrence of color bleeding, the main scan dot density of the color printing ink is desirably lower than that of the solid-color print ink. Thus, the main scan dot density may be favorably set for the solid-color print ink and the color printing ink, respectively. Further favorably, any target region may be adequately solid-color printed with the solid-color print ink without compromising a desirable image quality to be achieved by the color printing ink.

[Aspect 18] A printing method of printing an object on a medium by inkjet printing is provided. The printing method includes: prompting at least one or more ink jet heads to perform main scans in which the at least one or more ink jet heads discharge the ink droplets while moving in a main scanning direction previously set. The at least one or more ink jet heads have: a solid print nozzle through which ink droplets of an ink for solid print of a preset region are discharged; and a color printing nozzle through which ink droplets of a color printing ink are discharged. When the density of ink dots formed on the medium by one nozzle in a preset number of the main scans is defined as a main scan dot density, the printing method prompts the solid print nozzle to form the ink dots at a first main scan dot density, and prompts the color printing nozzle to form ink dots at a second main scan dot density lower than the first main scan dot density. This printing method may produce technical effects similar to the aspect 15.

Effect of the Disclosure

This disclosure may be useful in attaining high glossiness of the glossy ink fixated to the medium.

BRIEF DESCRIPTION OF THE DRAWINGS

FIG. 1A and FIG. 1B are respectively a front view and an upper view of the printing device 10, illustrating its main structural components by way of example.

FIG. 2A is a drawing of an example of the head unit 12. FIG. 2B is a drawing of another example of the head unit 12.

FIG. 3 is a table showing conditions of a test conducted to study a relationship between dot sizes and degrees of resolution.

FIG. 7A shows a first condition. FIG. 7B shows a second condition.

FIG. 8 presents enlarged photographs showing a metallic ink printing test result.

FIG. 10A is a drawing of an ink droplet landing order and a metallic ink print result when the printing pass number was 4. FIG. 10B is a drawing of an ink droplet landing order and a metallic ink print result when the printing pass number was 8.

FIG. 11 is a drawing of an ink droplet landing order and a metallic ink print result when a lateral shift mask was used.

FIG. 14 is a drawing of preferable conditions for metallic ink printing.

FIG. 15A is a drawing of exemplified specific features of the head unit 12. FIG. 15B is a schematic drawing of the head unit 12.

FIG. 16A through FIG. 16C are drawings illustrating nozzle array division in further detail. FIG. 16A is a table showing exemplified numbers of regions for nozzle array division. FIG. 16B is an exemplified region setting when the head division number is 5. FIG. 16C shows an exemplified ink layer formed by metallic color printing.

FIG. 18A is a drawing of an exemplified overlap between metallic ink dots. FIG. 18B is a table showing exemplified properties of a metallic ink used.

DESCRIPTION OF EMBODIMENT

Figure 1A:
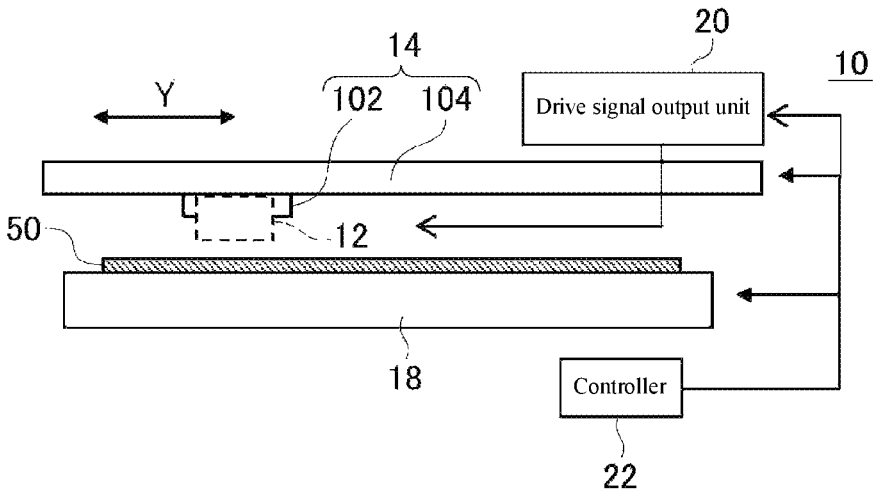
FIG. 1A and FIG. 1B are drawings of a printing device 10 according to an embodiment of this disclosure.
Figure 1B:
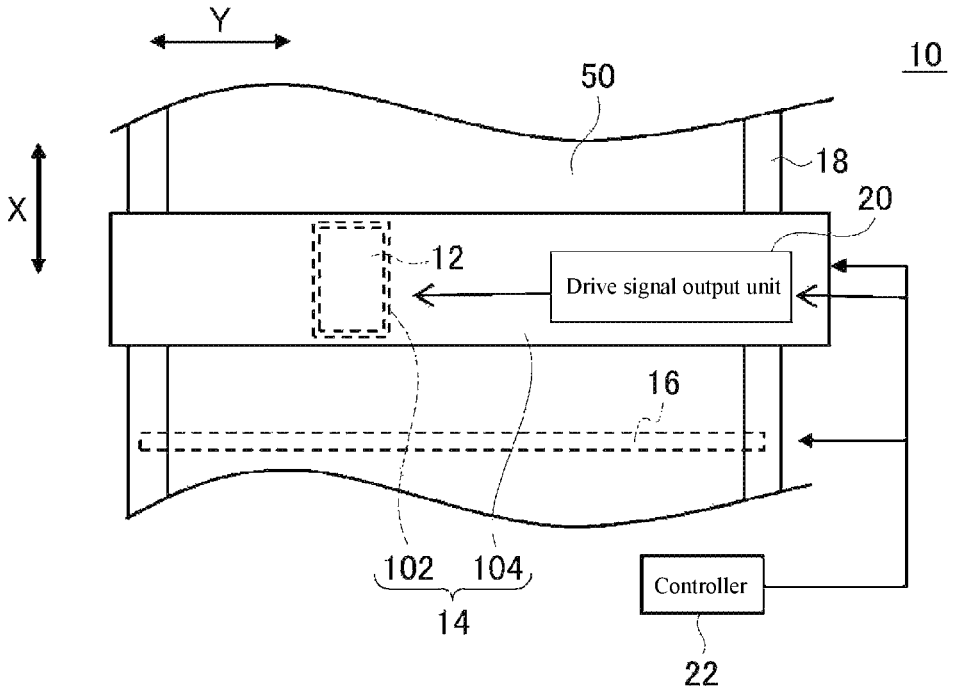

Hereinafter, embodiments of this disclosure are described in detail referring to the accompanying drawings. FIG. 1A and FIG. 1B are drawings of a printing device 10 according to an embodiment of this disclosure. FIG. 1A and FIG. 1B are respectively a front view and an upper view of the printing device 10, illustrating its main structural components by way of example. Except for the features hereinafter described, the printing device 10 may be structurally and technically identical or similar to the known inkjet printers.

The printing device 10 is an inkjet printer that prints an object on a medium 50 by inkjet printing. In the embodiments hereinafter described, the printing device 10 is a serial inkjet printer that prompts ink jet heads to perform main scans. The printing device 10 includes a head unit 12, a main scan driver 14, a sub scan driver 16, a platen 18, a drive signal output unit 20, and a controller 22.

The head unit 12, to print an object on the medium 50, forms ink dots on the medium 50 correspondingly to pixels of an image to be printed as prompted by instructions from the controller 22. In this embodiment, the head unit 12 has a plurality of ink jet heads. The head unit 12 will be described later in further detail.

The main scan driver 14 prompts the ink jet heads of the head unit 12 to perform main scans. The main scan is specifically an operation in which the ink jet heads discharge the ink droplets onto the medium 50 while moving in a preset main scanning direction (for example, Y direction illustrated in the drawing). The main scan driver 14 has a carriage 102 and a guide rail 104. The carriage 102 holds the head unit 12, with nozzle arrays of the ink jet heads facing the medium 50. The guide rail 104 guides the carriage 102 in the main scanning direction. As prompted by instructions from the controller 22, the guide rail 104 moves the carriage 102 in the main scanning direction.

The sub scan driver 16 prompts the ink jet heads of the head unit 12 to perform sub scans. The sub scan is specifically an operation in which the ink jet heads move relative to the medium 50 in a sub scanning direction orthogonal to the main scanning direction. In this embodiment, the sub scan driver 16 is a roller that transports the medium 50. At intervals between the main scans, the ink jet heads perform the subs scans while the medium 50 is transported.

Optionally, the printing device 10, instead of transporting the medium 50, may move the ink jet heads relative to the medium 50 fixed at a position for the sub scans (for example, X-Y table type). In such a printing device, the sub scan driver 16 may be a driving unit that moves the ink jet heads by moving the guide rail 104 in the sub scanning direction.

The platen 18 is a member in the form of a table on which the medium 50 is mounted. The platen 18 supports the medium 50 in a manner that the medium 50 is directed toward nozzle-formed surfaces of the ink jet heads of the head unit 12. In this embodiment, the platen 18 may have a heater for heating the medium 50 at a position across the head unit 12. The heater heats the medium 50 to fixate a discharged ink to the medium 50. The heater, by heating the medium 50, volatilizes and strips a solvent contained in the ink on the medium 50. The platen 18 may have a plurality of heaters. For example, the platen 18 may have a heater that heats the medium 50 at a position behind ink droplet landing positions (pre-heating unit), and a heater that heats the medium 50 at a position across the head unit 12 (platen heater). In addition to these heaters, another heater may be further provided that heats the medium 50 at a position more downstream than the head unit 12 in the transport direction of the medium 50 (after-heating unit).

The drive signal output unit 20 outputs drive signals to the plurality of ink jet heads of the head unit 12. The drive signals described herein are outputted to control the operations of driver elements (for example, piezoelectric elements) disposed at locations of the nozzles in the ink jet heads. In the main scans, the drive signal output unit 20 controls the operations of the driver elements and prompts the ink jet heads to discharge the ink droplets through their nozzles.

The controller 22 may be the CPU of the printing device 10. The controller 22, as prompted by instructions from, for example, a host PC, controls the operations of the structural components of the printing device 10. The printing device 10 equipped with these structural components prints an object on the medium 50. Specifics of the head unit 12 are hereinafter described.

Figure 2A:
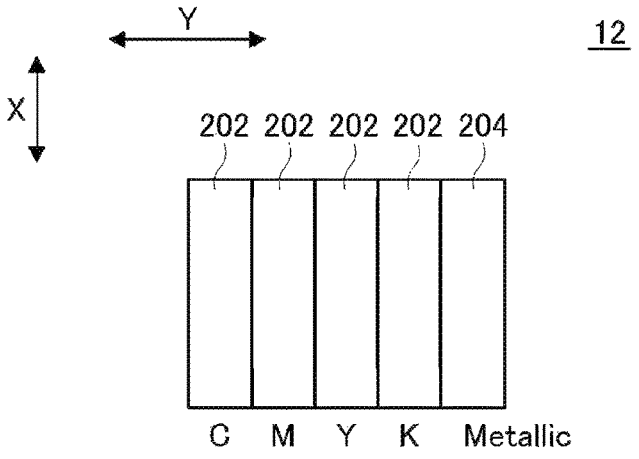
FIG. 2A and FIG. 2B are drawings of exemplified specific features of a head unit 12.
Figure 2B:
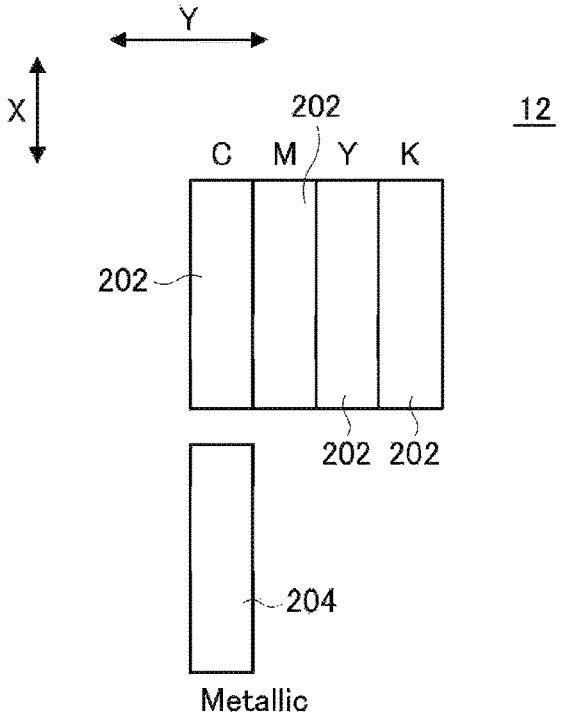

FIG. 2A and FIG. 2B are drawing of exemplified specific features of a head unit 12. FIG. 2A is a drawing of an example of the head unit 12. In the illustrated example, the head unit 12 has a plurality of ink jet heads; a plurality of color ink heads 202, and a metallic ink head 204. Though not illustrated in the drawing, the color ink heads 202 and the metallic ink head 204 each have a nozzle array having nozzles aligned in a row in the sub scanning direction (X direction).

The color ink heads 202 are ink jet heads that discharges ink droplets of color printing inks. Examples of the color printing ink may include the C, M, Y, and K color inks, in which case the color ink heads 202 discharge ink droplets of C, M, Y, and K color inks, respectively. As illustrated in FIG. 2A, the color ink heads 202 are arranged in the main scanning direction in positional alignment with one another in the sub scanning direction. The color ink heads 202 in this arrangement discharge ink droplets onto the same region of the medium 50 in each main scan.

The color printing inks discharged from the color ink heads 202 may be selected from the known inks. For example, the color ink heads 202 discharge ink droplets of solvent inks in C, M, Y, and K colors, respectively. The solvent ink may contain a pigment and an organic solvent. The organic solvent may be a volatile organic solvent. The solvent inks used in the color ink heads 202 may be selected from the known solvent inks. Optionally, the color printing inks may be solvent UV inks. The solvent UV ink, for example, contains an ultraviolet-curable monomer or oligomer, and an organic solvent. The solvent UV ink may be an ultraviolet curing-type ink diluted with an organic solvent.

The metallic ink head 204 is an example of the glossy ink head that discharges ink droplets of a metallic color ink (metallic ink). The metallic ink is an example of the glossy ink. The glossy ink head is an ink jet head that discharges ink droplets of the glossy ink. The glossy ink has a glossy color. The glossy ink may contain a glossy pigment and a solvent. The glossy ink may contain a light-reflecting pigment including scaly particles. Optionally, the glossy ink may be a pearl color ink. In this instance, the head unit 12 further has an ink jet head that discharges a pearl color ink as an example of the glossy ink head.

As illustrated in FIG. 2A, the metallic ink head 204 is disposed next to the color ink heads 202 in the main scanning direction in positional alignment with these color ink heads in the sub scanning direction. In each main scan, the metallic ink head 204 discharges the ink droplets onto the same region on the medium 50 as targeted by the color ink heads 202.

The metallic ink used in the metallic ink head 204 may be selected from the known metallic inks. The metallic ink head 204 discharges ink droplets of a solvent ink having a metallic color. The metallic color solvent ink may be an ink containing an organic solvent and a metallic color pigment containing scaly particles. The organic solvent may be a volatile organic solvent. The organic solvent is a principal ingredient of the metallic ink. The principal ingredient of the ink means an ingredient that accounts for 50% or more by weight of the ink. Suitable examples of the organic solvent may include glycol ether-based solvents. The metallic ink may further contain a binder resin. The metallic ink in the illustrated example may be a silver color ink. The silver color metallic ink may contain a pigment made of metal, for example, aluminum. Examples of the metal-made pigment may include pigments made of gold, silver, brass, and alloys. Optionally, the metallic ink may be a solvent UV ink.

When the metallic ink is used for printing, a predetermined region may be solid-color printed with the metallic ink alone, without the ink droplets of the color printing inks (CMYK) being discharged to the region. When a region is painted out with the metallic ink, the ink droplets of the metallic ink may be discharged a predetermined concentration (for example, 100% concentration). In that case, the ink droplets may be discharged from the metallic ink head 204 alone in the main scans for the region, without the ink droplets being discharged from the color ink heads 202. Then, a target region may be printed with the metallic ink by using the ink jet heads of FIG. 2A in this manner.

Except for the technical points described so far and below, the printing device 10 (see FIG. 1A and FIG. 1B) may carry out the printing operation in a manner identical or similar to the known methods using the color ink heads 202 and the metallic ink head 204. For example, the printing device 10 may operate identically or similarly to the known printing devices, except for specifics of the ink droplet discharge from the metallic ink head 204. The specifics of the ink droplet discharge from the metallic ink head 204 may include how to select ink droplet sizes and target pixels of the ink droplets discharged.

Specifically, the color ink heads 202 of the printing device 10 may operate identically or similarly to color ink heads of the known printing devices. The printing device 10 may print an object in multiple passes. In such multipass printing, plural main scans for plural printing passes are performed at each one of positions on the medium 50 (see FIG. 1A and FIG. 1B). In the multipass printing, the color ink heads 202 and the metallic ink head 204 respectively discharge the ink droplets to pixel positions selected based on preset mask data. This mask data indicates data that designate target pixels of the ink droplets discharged in each printing pass. The mask data may be rephrased as data that regulate an ink droplet landing order. The multipass printing using the mask data may enable high-resolution printing. The color ink heads 202 and the metallic ink head 204 may discharge the ink droplets to pixel positions selected by the same mask data. Then, the multipass printing does not require an overly complicated operation control.

The color ink heads 202 and the metallic ink head 204 may be prompted to perform the main scans unidirectionally or bidirectionally as appropriate. The unidirectional main scan refers to a main scan in which the color ink heads 202 and the metallic ink head 204 move one way only in the main scanning direction. The bidirectional main scan refers to a main scan in which the color ink heads 202 and the metallic ink head 204 move both ways in the main scanning direction. The ink droplets are discharged while the ink jet heads are moving both ways in the main scanning direction.

The color ink heads 202 and the metallic ink head 204 may be multiple ink jet heads each consisting of a plurality of ink jet heads, or staggered heads each having a plurality of ink jet heads disposed in staggered arrangement.

The color ink heads 202 and the metallic ink head 204 of the head unit 12 may be arranged differently to the example illustrated in FIG. 2A. FIG. 2B is a drawing of another example of the head unit 12. Except for the features described below, the structural components illustrated in FIG. 2A and FIG. 2B with the same reference signs are identical or similar components.

In the illustrated example of FIG. 2B, the metallic ink head 204 is positionally displaced from the color ink heads 202 in the sub scanning direction. In each main scan, the metallic ink head 204 of this head unit, while moving simultaneously with the color ink heads 202 in the main scanning direction, discharges the ink droplets onto a region of the medium different from a target region of the color ink heads 202. The head unit thus characterized may allow the medium to be favorably printed with the color printing inks and the metallic ink.

The operation of the metallic ink head 204 in this embodiment is described in further detail. The metallic ink head 204 discharges the ink droplets onto the medium 50 during the main scans. In each one of the main scans, the metallic ink head 204 discharges the ink droplets plural times while moving in the main scanning direction to form ink dots at positions on the medium 50 along the main scanning direction.

The ink droplets discharged from the metallic ink head 204 each have a volume constituting a size that allows for contact on the medium 50 between the dots formed in each one of the main scans. This volume may be rephrased as a volume constituting a size that allows for contact on the medium 50 between any ones of dots formed by the metallic ink head 204 in each one of the main scans.

The contact on the medium 50 between the ink dots formed in each main scan may be rephrased as contact between contiguous ones in the main scanning direction of the dots formed in the same main scan. The contact between the ink dots on the medium 50 may be rephrased as contact between the ink dots in liquid state before the solvent is volatilized and stripped from the ink dots. The contact between the liquid ink dots may be rephrased as contact between the ink dots that allow them to be merged into one dot.

The contact on the medium 50 between any ones of dots may be contact on the medium 50 between any ink dots among substantially all of the dots formed by the metallic ink head 204. The substantially all of the dots may be any dots but dots to be excluded in connection with designing requirements for pixel selection and/or operation errors of the metallic ink head 204. The substantially all of the dots may be any dots but dots that can be excluded to an extent that does not affect the appearance of a printed matter. The volume of an ink droplet may be a designed volume.

As described earlier, the metallic ink head 204 in this embodiment has a nozzle array having a plurality of nozzles aligned in a row in the sub scanning direction. In each main scan, the metallic ink head 204 discharges the ink droplets through the nozzles of the nozzle array. By having the ink droplets discharged, the ink dots arranged in the sub scanning direction are formed on the medium 50 in positional alignment with one another in the main scanning direction. In this instance, preferably, the ink droplets discharged from the metallic ink head 204 may each have a volume constituting a size that allows for contact on the medium 50 between any ones of the dots formed contiguously in the sub scanning direction in positional alignment with one another in the main scanning direction.

As described earlier, the printing device 10 in this embodiment may carry out the multipass printing. In the multipass printing, the ink droplets of the metallic ink are discharged from the metallic ink head 204 to at least alternate ones of pixel positions in the main scanning direction. In this instance, alternate ones of pixel positions in the main scanning direction are specifically alternate pixel positions in the main scanning direction among pixels arranged suitably set for a demanded printing resolution. More specifically, alternate ones of pixel positions in the main scanning direction are positions spaced at an interval equal to a distance twice as large as a printing resolution pitch in the main scanning direction. The ink droplet having a volume constituting a size that allows for contact on the medium 50 between the dots formed in each main scan may be rephrased as the ink droplet having a volume that allows the dot formed by an ink droplet to have a diameter at least twice or more than twice of the resolution pitch in the main scanning direction.

To print an object using the metallic ink printing while attaining high glossiness, for example, orientational randomness of the pigment at the time of fixating the ink is desirably suppressed. Taking a pigment containing scaly particles, for example, scaly particles of the pigment are desirably fixated to the medium 50 like scales (two-dimensionally). In the case of forming the dots using the metallic ink head 204 under a printing condition that prevents intermingling of different dots, the dots may be dried more quickly. This may often leave the pigment particles randomly oriented in the dots at the time of fixating the ink to the medium 50. As a result, high glossiness may not be attained.

In this embodiment, the dots of the metallic ink are merged on the medium 50 into dots greater in size. This may lengthen the time required to volatilize and strip the solvent (organic solvent), and the metallic ink fixated to the medium may result in a very glossy appearance. According to this embodiment, the metallic ink fixated to the medium 50 may result in high glossiness.

In this embodiment, the ink droplets of the metallic ink discharged from the metallic ink head 204 are increased in volume to ensure high glossiness. The head unit 12, however, has the color ink heads 202 in addition to the metallic ink head 204. If the ink droplets of the color printing inks, C, M, Y, and K inks, are discharged in an overly abundant volume, high-accuracy printing may be undermined. In the case of the color printing inks, any contact between the ink dots on the medium 50 may result in a degraded printing quality. Specifically, any contact between the ink dots in different colors may cause the colors to bleed into each other, degrading the printing quality. To attain a high resolution when the color printing inks are used for printing, the ink dots formed on the medium 50 need to be adequately small in size.

In this embodiment, an ink droplet discharged from each color ink head 202 may preferably have a volume smaller than an ink droplet discharged from the metallic ink head 204. The ink dot formed on the medium 50 by an ink droplet discharged from each color ink head 202 is accordingly reduced in size as compared the ink dot formed on the medium 50 by an ink droplet discharged from the metallic ink head 204. The ink dot size may be specifically the diameter of an ink dot. The ink dot diameter may be a designed diameter.

Specifically, the ink droplets discharged from the color ink heads 202 may each have a volume constituting a size that allows for no contact between the dots on the medium 50. No contact between the dots on the medium 50 may be rephrased as no contact on the medium 50 between the ink dots formed in the same main scan. As a result, the color printing ink dots may be successfully formed in adequately small sizes. Then, the occurrence of color bleeding may be prevented, and high-resolution and high-quality printing may be successfully effectuated.

To have the ink droplets discharged in different volumes from the color ink heads 202 and the metallic ink head 204, different drive signals may be supplied to the color ink heads 202 and the metallic ink head 204. To this end, the drive signal output unit 20 (see FIG. 1A and FIG. 1B) outputs a first drive signal to the color ink heads 202. The first drive signal changes in a preset first waveform. The drive signal output unit 20 further outputs a second drive signal to the metallic ink head 204. The second drive signal changes in a waveform different from the first waveform of the first drive signal. The second drive signal drives the ink droplets to be discharged in a greater volume than the first drive signal. The second drive signal that changes in the waveform different from the waveform of the first drive signal may indicate that the second drive signal differs in signal level (voltage) alone from the first drive signal.

In this manner, the ink droplets of the metallic ink and the color printing inks may be discharged in appropriate volumes, respectively. For both of the metallic ink and the color printing inks, therefore, the ink dot size of an ink droplet may be adjusted to a suitable size.

Examples of the metallic ink may include inks more spreadable on the medium 50 than the color printing inks. This may facilitate the setting of conditions that allow for contact on the medium 50 between the ink dots of the metallic ink. Then, the metallic ink fixated to the medium may result in high glossiness.

The ink being spreadable on the medium 50 may indicate the ink being spreadable in a diametrically greater size by the time when the solvent is volatilized and stripped. Examples of the inks easily spreadable on the medium 50 may include inks that speedily spread as soon as they landed on the medium 50, and inks difficult to be repelled against the medium 50. The inks difficult to be repelled against the medium 50 may have a higher affinity with the medium 50. In this embodiment, the metallic ink may be an ink containing an additive(s) that improves affinity with the medium 50 in a greater volume than the color printing inks.

According to this embodiment, a highly glossy print result may be obtained by the metallic ink, and a high-resolution print result with a high quality may be obtained by the color printing inks.

The inventors of this application conducted tests in relation to the technical matters disclosed herein. These tests are hereinafter described. To start with, the inventors of this application conducted a test on a relationship among ink dot sizes, degrees of resolution, and degrees of glossiness (values of glossiness). FIG. 3 to FIG. 6 show the test result on the relationship among ink dot sizes, degrees of resolution, and degrees of glossiness. FIG. 3 shows the test conditions. In this test, the inventors set some fixed printing conditions illustrated in FIG. 3, while changing other conditions.

To have the conditions subject to changes, two different driving waveforms for variable dot (VD) were used. The driving waveforms were WF6 waveform and WF8 waveform used in the known inkjet printers supplied by MIMAKI ENGINEERING CO., LTD. By using the driving waveforms for VD, the volume of an ink droplet discharged from each nozzle of the ink jet heads is changeable through stages. At the WF6 and WF8 waveforms used in this test, ink droplet volumes were changed for three different dot sizes; small (S), mid-sized (M), and large (L). One of the drawings shows the diameters (dot gains) of the dots in the respective sizes in the main scanning direction (Y direction) and the sub scanning direction (X direction), and ink droplet volumes (shot volumes) for the different dot sizes.

Figure 4:
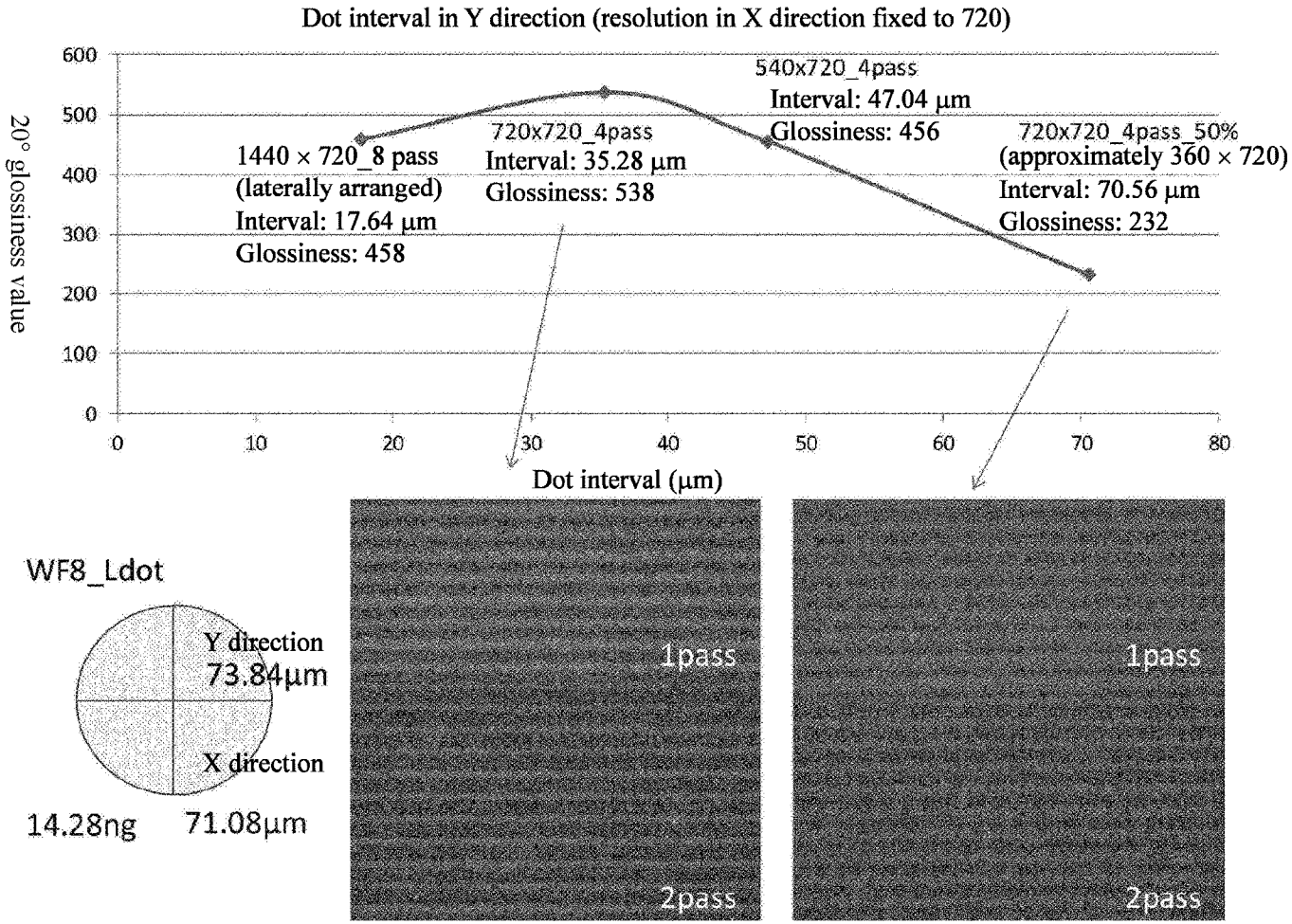
FIG. 4 is a drawing of a test result on a relationship between degrees of glossiness and dot intervals in a main scanning direction.
Figure 5:
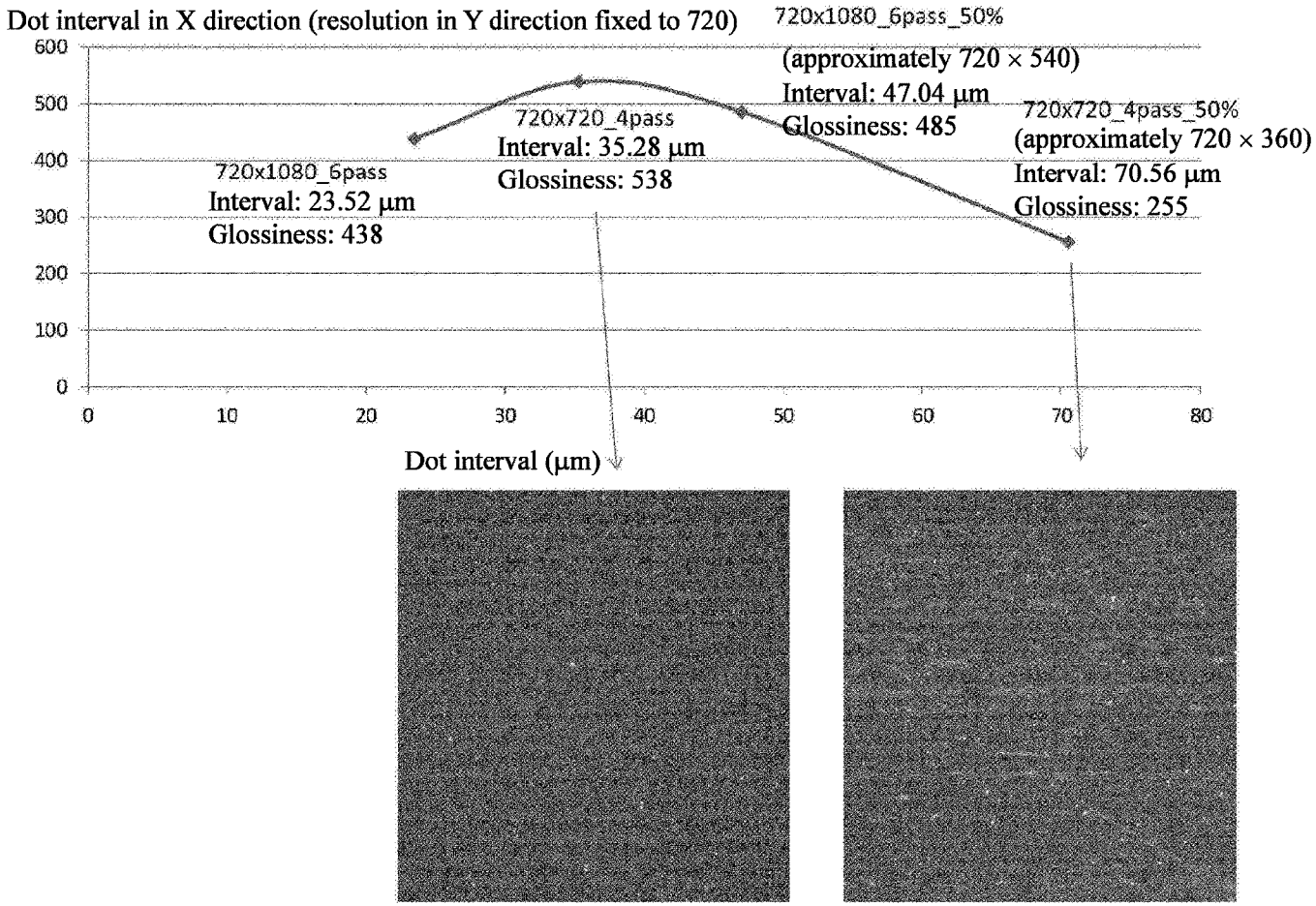
FIG. 5 is a drawing of a test result on a relationship between degrees of glossiness and dot intervals in a sub scanning direction.

The inventors conducted tests under these printing conditions. FIG. 4 is a drawing showing the test result on the relationship between degrees of glossiness and dot intervals in the main scanning direction (Y direction). FIG. 5 is a drawing showing the test result on the relationship between degrees of glossiness and dot intervals in the sub scanning direction (X direction). In these tests, the WF8 waveform was used as the driving waveform, and the ink dots were formed in the large size (L). During the printing operation, the dot interval in the main scanning direction was variously changed to obtain degrees of glossiness under the different conditions. The dot interval was changed by changing the printing solution (resolution mesh).

As is known from the graphs and photographs of FIG. 4 and FIG. 5, the glossiness obtained from the metallic ink changed with different dot intervals. The larger dot intervals resulted in more noticeable declines in glossiness.

In these tests, the glossiness exhibited its peak at the resolution of 720×720 dpi in both of the dot intervals in the main and sub scanning directions (the same resolution of 720 dpi in both of the main and sub scanning directions). It may be learnt from the result that the glossiness is degraded when the dot interval is either larger or smaller than the optimal dot interval. However, the lower degrees of glossiness observed when the dot intervals are increased and decreased are probably attributed to different factors, as described below.

At smaller dot intervals, the ink discharged volume per unit area may increase, making the ink difficult to dry. This suggests that taking enough time to dry the ink may attain high glossiness. At larger dot intervals, the ink discharged volume per unit area may decrease, making the ink easy to dry. This may worsen the orientational randomness of the fixated pigment of the metallic ink, possibly degrading the glossiness.

Figure 6:
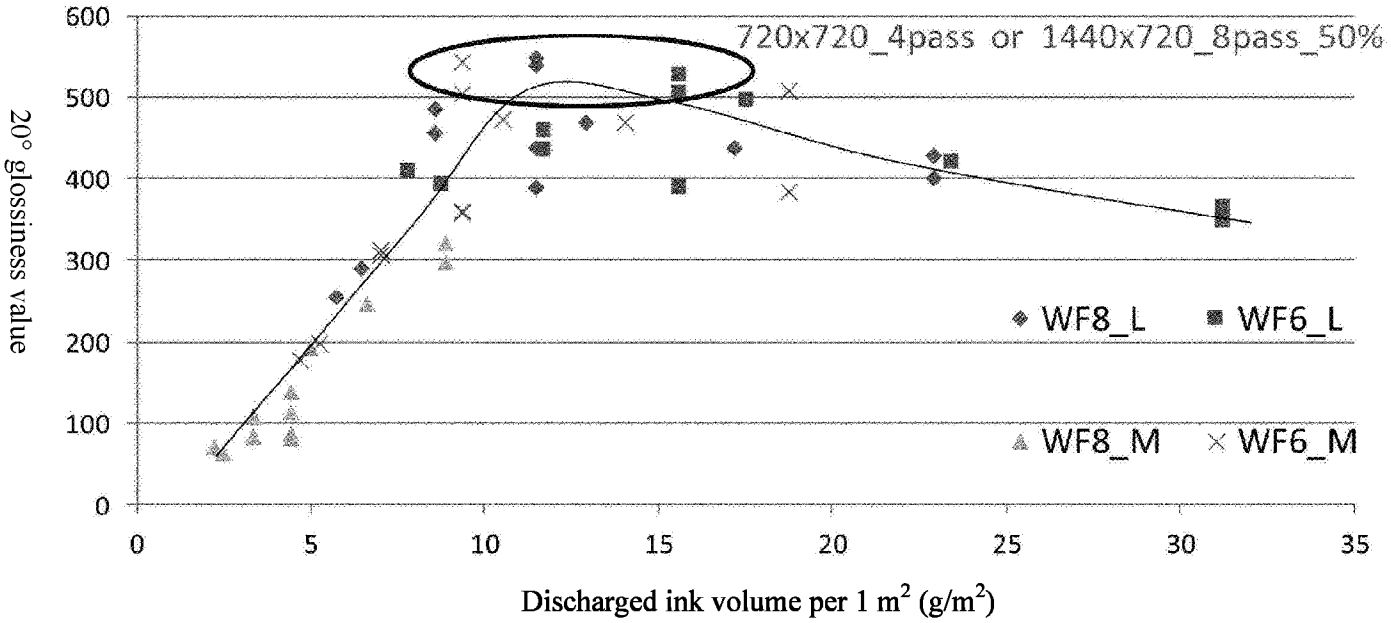
FIG. 6 is a drawing of a test result on a relationship between degrees of glossiness and discharged ink volumes per unit area.

The inventors of this application then conducted a test on a relationship between discharged ink volumes per unit area and degrees of glossiness. FIG. 6 is a drawing showing the test result on the relationship between degrees of glossiness and discharged ink volumes per unit area. This test employed the conditions illustrated in the graph, and checked degrees of glossiness under the different conditions while variously changing the discharged ink volume per unit area (1 $m^2$).

As is clear from the graph, the glossiness shows a sudden drop once the discharged ink volume per unit area falls below a certain value (for example, approximately, 10 $g/m^2$). In this instance, high glossiness may not be attained. The glossiness is degraded by smaller degrees with increase of the discharged ink volume per unit area than decrease of the volume. This may strongly suggest the importance of avoiding any conditions that may lead to shortage of the discharged ink volume per unit area in order to attain high glossiness. Specifically, when the dot gain changes by approximately 70 to 90 μm (shot volume: approximately 12 to 19 ng), the resolution of 720×720 dpi may result in excellent glossiness equal to or higher than 500.

The test result suggests that an abundant volume of the ink should be discharged per unit area for high glossiness. This necessitates an adequately large volume of the ink droplets, so that the dot sizes are large enough for the printing resolution (dot intervals).

In the printing device 10 described referring to FIG. 1A, FIG. 1B, FIG. 2A and FIG. 2B, the ink droplets discharged from the metallic ink head 204 each have a volume constituting a size that allows for contact on the medium 50 between the dots formed in each main scan. By thus adequately increasing the ink droplets in volume, a highly glossy print result may be obtained from the metallic ink.

Figure 7A:
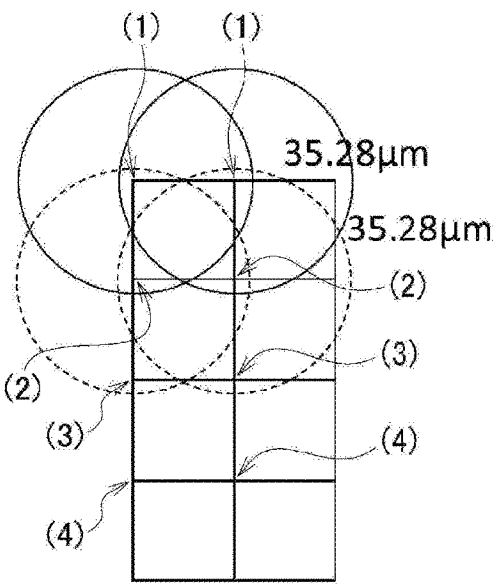
FIG. 7A and FIG. 7B are drawings of preferable conditions in connection with a relationship between degrees of printing resolution and ink droplet volumes.
Figure 7B:
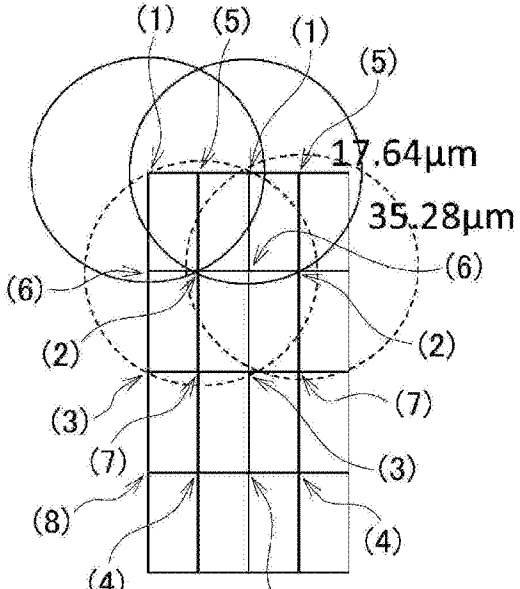

FIG. 7A and FIG. 7B are drawings of preferable conditions in connection with the relationship between degrees of printing resolution and ink droplet volumes. These conditions are preferably employed when the WF8 waveform is used as the driving waveform, and the ink droplets discharged from the metallic ink head 204 are each set to be large enough for dots in the large size (L).

FIG. 7A shows a first condition. The requirements of the first condition are: printing resolution of 720×720 dpi; inter-dot distance of 35.28 μm in the main scanning direction (Y direction) and the sub scanning direction (X direction); multipass printing with the pass number of 4; and printing concentration of 100%.

Referring to FIG. 7A, each lattice point between cells represents a pixel position set in accordance with the printing resolution. The numbers (1) to (4) at the pixel positions represent printing pass numbers for the discharge of ink droplets to the respective pixel positions. Referring to the pixel position with the number (1), for example, the ink droplets are discharged to this position in the first printing pass. The ink droplets are discharged to the pixel positions with the numbers (2) to (4) in the second to fourth printing passes. Having the ink droplets thus discharged may cause the ink dots to adequately contact one another on the medium 50 by each printing pass. Thus, a highly glossy print result may be obtained from the metallic ink.

FIG. 7B shows a second condition. Except for the points described below, the second condition is identical or similar to the first condition. The requirements of the second condition are: printing resolution of 1440×720 dpi, resolution of 1440 dpi in the main scanning direction, and resolution of 720 dpi in the sub scanning direction. In this instance, pixel positions set in accordance with the printing resolution correspond to positions of the lattice points between the cells in the drawing. The other requirements are; multi-pass printing with the pass number of 8; and printing concentration of 50%, half the concentration in the first condition.

The ink droplets are discharged to the pixel positions based on the printing pass numbers of (1) to (8). In this instance, pixels are selected in a staggered manner. The ink droplets are discharged to the pixel positions with the numbers (1) to (8) in the first to eighth printing passes. Having the ink droplets thus discharged may also cause the ink dots to adequately contact one another on the medium 50 by each printing pass. Thus, a highly glossy print result may be obtained from the metallic ink.

FIG. 8 shows enlarged photographs of print results using the metallic ink. One of them is an enlarged photograph of a print result obtained under the first condition, while the other one is an enlarged photograph of a print result obtained under a comparative condition. In the print result obtained under the first condition, the ink dots were merged into dots greater in size on the medium as is seen in the photograph. As a result, high glossiness was attained.

The other print result was obtained under the comparative condition: multipass printing with the printing pass number of 2; resolution of 360×360 dpi; and concentration of 6.25%. This condition leaves larger intervals between the dots formed in the same main scan, precluding the possibility of the dots being merged. As is seen in the drawing, the ink dots are distantly spaced on the medium. In this comparative example, therefore, the solvent contained in the ink is quickly volatilized and stripped. Under this condition, expected glossiness was not obtained.

The inkjet printing is typically performed in multiple passes, and the multipass printing performs plural main scans at the same position on the medium. An issue with the multipass printing in connection with drying of the ink dots may be a time interval between the finish of a main scan and the start of a next main scan. Taking low-pass mode printing for instance, some of the scans may be empty scans that only involve the movement of ink jet heads, while suspending the discharge of ink droplets. This may possibly leave drying marks on a print result. Then, other problems may follow; degraded image quality and/or streaks running in the main scanning direction.

The inventors of this application further conducted tests to find out more effective ways of selecting target pixels for the discharge of ink droplets in each main scan in the multipass printing. Specifically, the tests focused on the relationship among the printing pass numbers (pass division numbers), mask data (mask), and degrees of glossiness.

Figure 9:
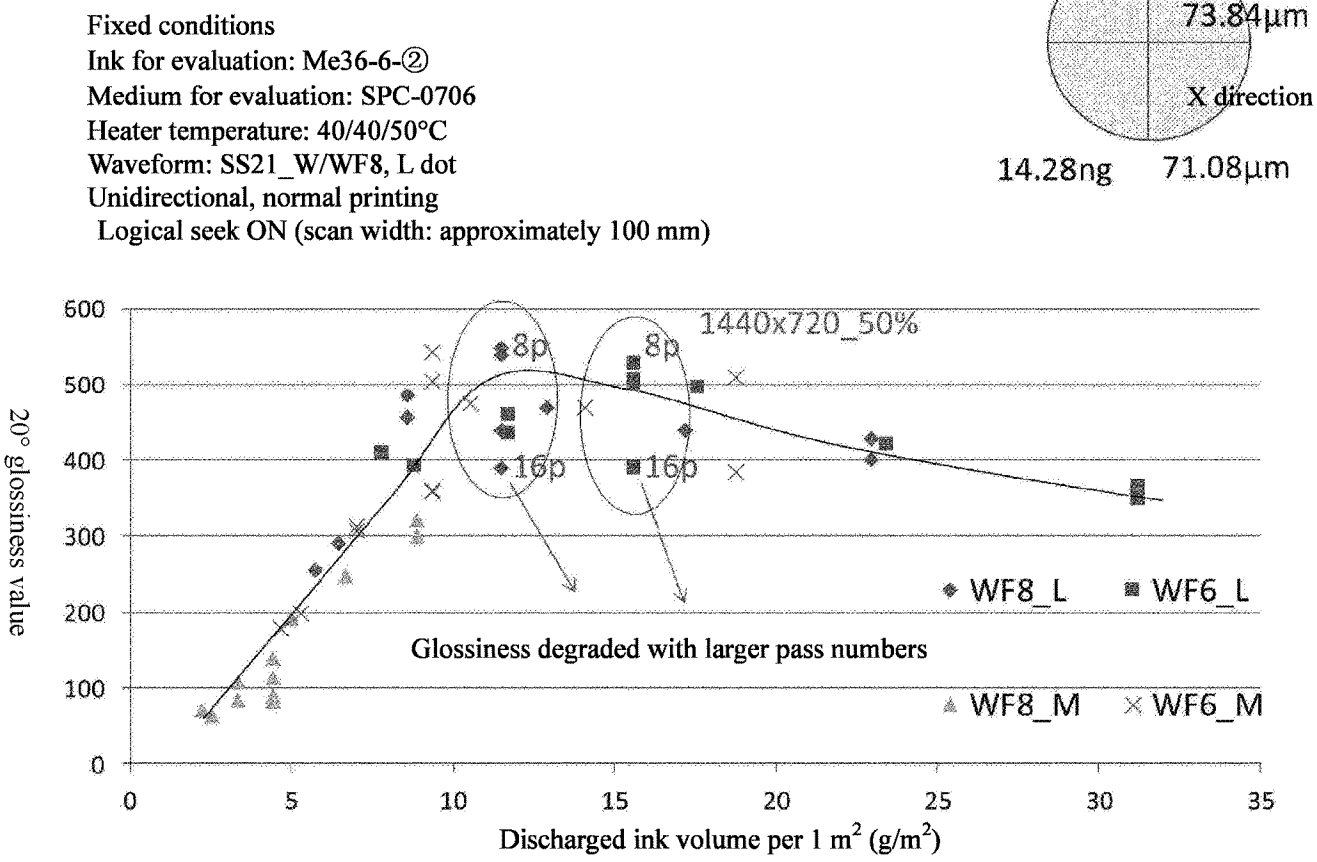
FIG. 9 is a drawing of a relationship between degrees of glossiness and printing pass numbers obtained from the test.

FIG. 9 is a drawing of the relationship between degrees of glossiness and printing pass numbers obtained from the tests. The relationship between degrees of glossiness and printing pass numbers in this drawing is based on the same data as in the graph of FIG. 6. As for the relationship between degrees of glossiness and printing pass numbers, the graph of FIG. 9 shows that the glossiness is degraded with larger printing pass numbers.

Figure 10A:
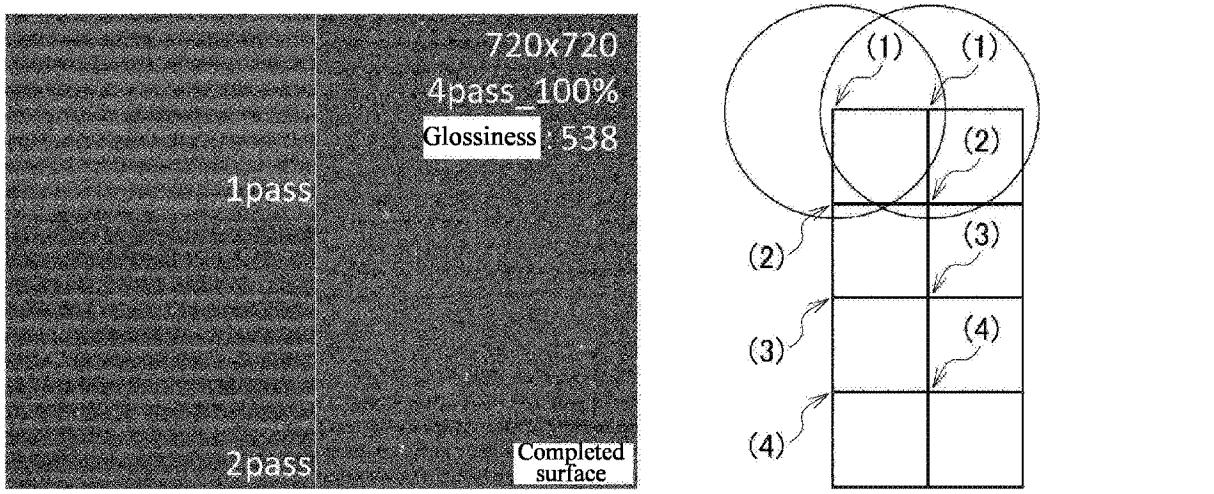
FIG. 10A and FIG. 10B are drawings of a relationship between printing pass numbers and an ink droplet landing order representing the timing of each ink droplet landing at a pixel position.
Figure 10B:
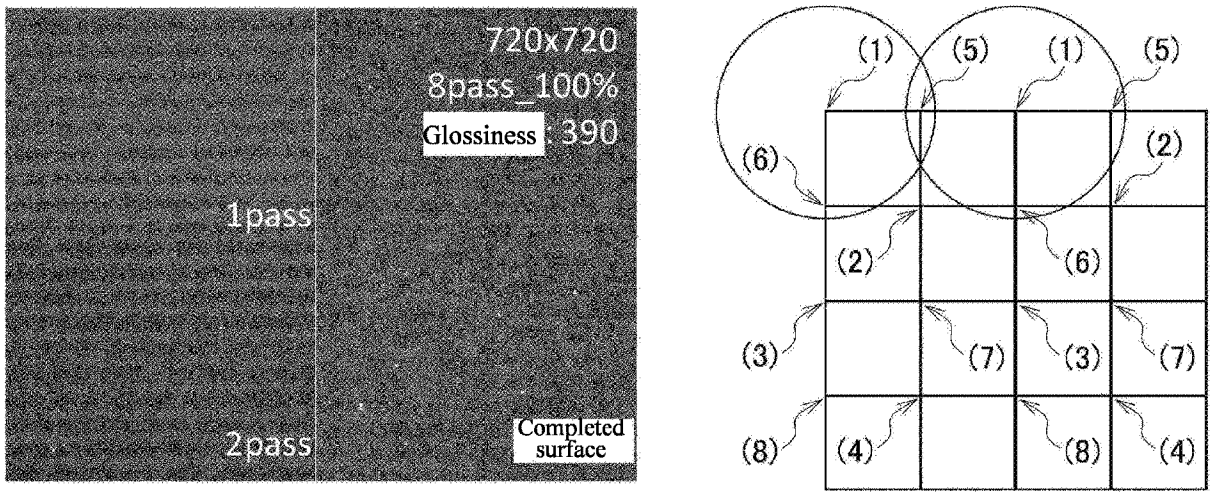

FIG. 10A and FIG. 10B are drawings of the relationship between printing pass numbers and an ink droplet landing order representing the timing of each ink droplet landing at each pixel position. FIG. 10A is a drawing of an ink droplet landing order and a metallic ink print result when the printing pass number was 4. FIG. 10B is a drawing of an ink droplet landing order and a metallic ink print result when the printing pass number was 8. Referring to FIG. 10A and FIG. 10B, each lattice point between cells represents a pixel position set in accordance with a printing resolution. The numbers (1) to (4) or (1) to (8) at the pixel positions represent printing pass numbers for the discharge of ink droplets to the respective pixel positions.

In the example illustrated in FIG. 10A, the ink droplets are discharged in one main scan to contiguous ones of the pixel positions in the main scanning direction. In the example illustrated in FIG. 10B, on the other hand, the ink droplets are discharged in different main scans to contiguous ones of the pixel positions in the main scanning direction.

Conventionally, larger printing pass numbers may lead to larger intervals between the ink dots formed in one main scan. The dots thus distantly spaced may be unlikely to merge into one another. Further, timings of the ink droplets landing at contiguous pixel positions may differ to a greater extent. This may create gaps and irregular parts on the surface of an ink layer, resulting in poor glossiness. In fact, the glossiness of the example illustrated in FIG. 10B may be lower than the glossiness of the example illustrated in FIG. 10A, as illustrated in the drawing.

It is learnt from the comparison between examples illustrated in FIG. 10A and FIG. 10B that the glossiness may be further degraded with larger printing pass numbers. The glossiness may be thus degraded because intervals between the timings of the ink droplets landing at contiguous pixel positions may increase with larger printing pass numbers.

A possible solution may be minimizing intervals between the timings of the ink droplets landing at contiguous pixel positions. Then, high glossiness may be attainable with larger printing pass numbers. To this end, lateral shift mask, for example, may be used as mask data for the multipass printing. By using the lateral shift mask for the selection of target pixels for the discharge of ink droplets in each main scan, the ink droplets are discharged in consecutive main scans to contiguous pixel positions in the main scanning direction.

FIG. 11 shows an ink droplet landing order and a metallic ink print result when the lateral shift mask was used. Referring to FIG. 11, each lattice point between cells represents a pixel position set in accordance with a printing resolution. The numbers (1) to (8) at the pixel positions represent printing pass numbers for the discharge of ink droplets to the respective pixel positions.

As is known from the print result illustrated in the drawing, the glossiness improved as compared to the example illustrated in FIG. 10B. Based on the result, using the lateral shift mask may be an effective solution for preventing the glossiness from degrading when large pass numbers are employed.

These test results indicate that the dot intervals corresponding to the resolution of 720×720 dpi may be preferable in the case where the dot sizes are approximately 70 to 90 μm (12 to 19 μm). As for the ink droplet landing order, the test results further indicate that landing timings that differ between contiguous pixels may greatly affect the glossiness. Using the lateral shift mask, therefore, may be advisable for large printing pass numbers. The requirements preferable for large printing pass numbers may be the use of lateral shift mask, printing pass number of 8, and resolution of 720×720 dpi. Instead of this condition, the printing concentration may be set to 50%, and the pixels may be thinned for one dot interval in the main scanning direction, in which case the use of lateral shift mask, printing pass number of 16, and resolution of 1440×720 dpi may be suggested.

The multipass printing by the inkjet printers may involve different settings, for example, different printing pass numbers and different pieces of mask data. Generalizing this condition, the ink droplets of the metallic ink may each preferably have a volume constituting a size that allows for contact on the medium between the dot formed in each main scan, as described referring to FIG. 1A, FIG. 1B, FIG. 2A and FIG. 2B. More specifically, the ink droplet may have a volume that allows the ink dot formed by an ink droplet to have a diameter twice as large as the resolution pitch in the main scanning direction.

Next, test results in connection with adverse impacts from empty scans in the multipass printing are hereinafter described. In the multipass printing, some empty scans may be interposed at constant intervals between the main scans under certain printing conditions in relation to, for example, feed of the medium to be transported. Such an irregular feed may change intervals between the timings of the ink droplets landing at the pixel positions. This event may incur undesired streaks in a print result, degrading the glossiness.

Figure 12:
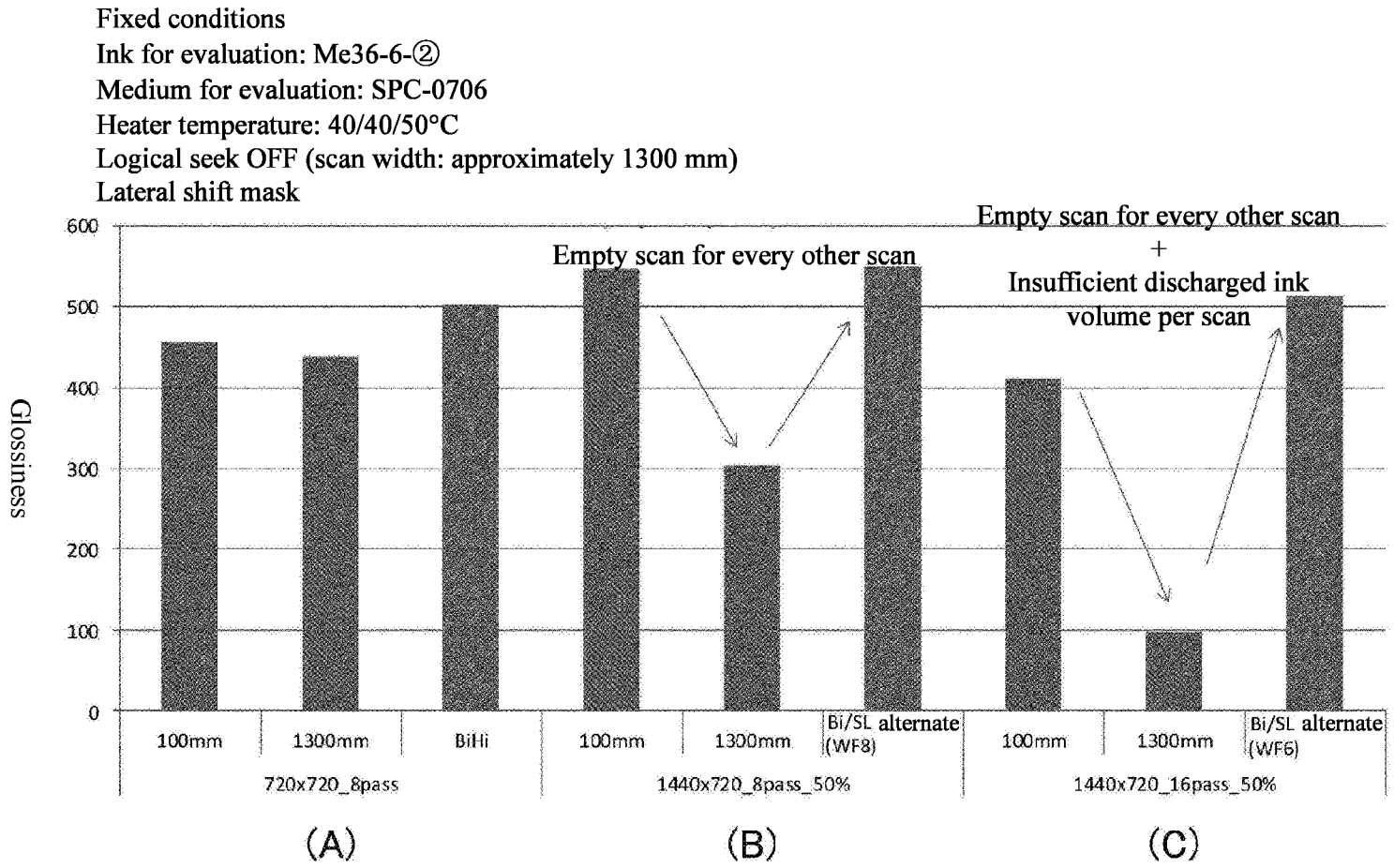
FIG. 12 is a drawing of a test result on adverse impacts by empty scans.

FIG. 12 is a drawing showing a test result in connection with adverse impacts by empty scans. In this test, the inventors set some fixed printing conditions illustrated in FIG. 12, while changing intervals between the main scans (scan intervals). To change the scan intervals, different moving distances of the ink jet heads (scan widths) were set for the main scans. This test employed two scan widths; 100 mm, and maximum scan width (full width) of 1,300 mm.

This test further used three conditions, illustrated with (A) to (C) in the drawing, for the resolution and the pass number. The condition (A) involves no empty scan. The condition (B) involves an empty scan for every other scan. The condition (C) involves an empty scan for every other scan and a reduced discharged ink volume in each main scan.

In the case where the scan width is set to the shorter width, 100 mm, time required for one main scan accordingly reduces. Then, the scan intervals become shorter, reducing the intervals between the timings of the ink droplets landing at contiguous pixel positions in different main scans. All of the conditions (A) to (C), therefore, resulted in high glossiness.

In the case where the scan width is set to the full width, one main scan takes more time, increasing the scan intervals. This increases the intervals between the timings of the ink droplets landing at contiguous pixel positions in different main scans. Under the condition (A) involving no empty scan, the glossiness may not be overly degraded. In this instance, bidirectional high-speed printing (BiHi), if employed, may further improve the glossiness, probably because of further reduced intervals between the timings of the ink droplets landing at contiguous pixel positions.

Under the conditions (B) and (C) involving empty scans, a print result in the full width may be significantly degraded in glossiness, as illustrated in the drawing, probably because of too large intervals between the timings of the ink droplets landing at contiguous pixel positions.

The inventors of this application then came up with the idea of adding bridging main scans for replacement of empty scans whenever the empty scans were necessary. The bridging main scans in this instance are main scans performed at times when the empty scans are supposed to occur. In the bridging main scans, for example, the ink droplets may be discharged at a predetermined concentration.

The inventors of this application further added the setting of bidirectional printing to the conditions (B) and (C), as illustrated with alternate Bi/SL, and further added the setting of variable dot so as to discharge the ink droplets for small size (S) dots in the main scans. They verified that high glossiness was obtainable by the main scans thus performed, and learnt that high glossiness was obtainable with large scan widths.

When the ink dots formed in any main scans (main dots) but the bridging main scans have the sizes of, for example, approximately 70 to 90 (approximately 14 to 19 ng), dots formed in the bridging main scans (bridging sub dots) may have the sizes of, for example, approximately 60 IAM (approximately 5 ng). As a result, excellent glossiness may be successfully attained.

Figure 13:
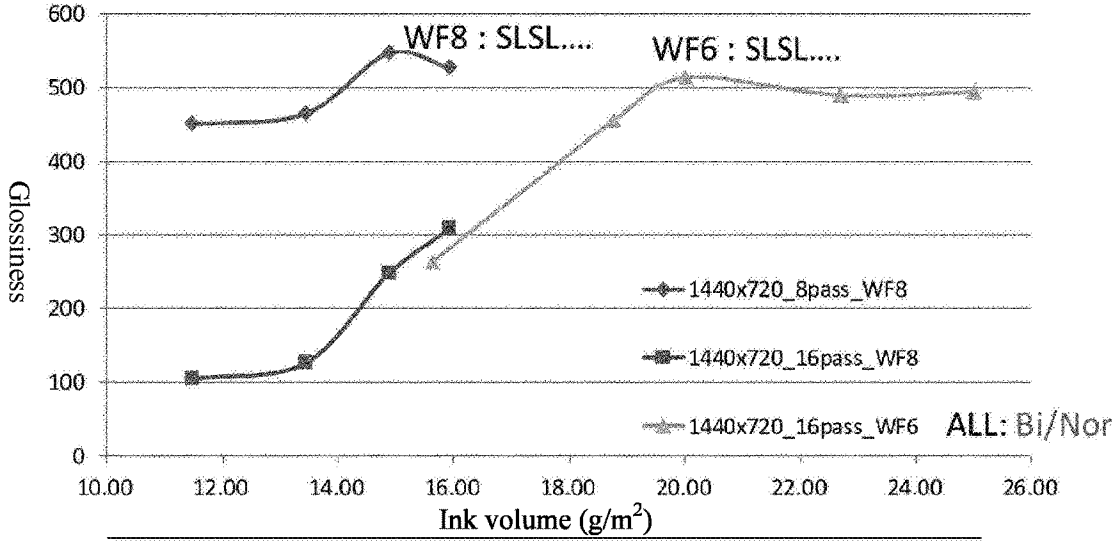
FIG. 13 is a drawing of a test result on a relationship between degrees of glossiness and discharged ink volumes per unit area.

Further, a test result on the relationship between the ink volumes per unit area and degrees of glossiness is hereinafter described as additional information for the test results described above. FIG. 13 is a drawing of a test result on the relationship between degrees of glossiness and discharged ink volumes per unit area. As illustrated in FIG. 13, this test, by using the ink dots in various sizes at the WF6 waveform and WF8 waveform, carried out the bidirectional printing with normal printing conditions to look into the relationship between degrees of glossiness and the ink volumes per unit area. This test indicates that the glossiness is lower with less ink volumes per unit area. When the printing pass number is set to a large number (for example, 16), the glossiness improved with larger ink volumes until a certain volume is reached.

In this instance, performing the bridging main scans, as described earlier, may be considered to serve the purpose of increasing the ink volumes per unit area. This leads the inventors to understand why and how the bridging main scans conduce to improvements of glossiness.

Next are described preferable examples of the specific printing conditions using the metallic ink based on the respective test results obtained so far. FIG. 14 shows preferable printing conditions when the metallic ink is used.

Based on the test results, the metallic ink printing may preferably be carried out under any one of the conditions (A) to (C) illustrated in the drawing. Referring to FIG. 14, each lattice point between cells represents a pixel position set in accordance with a printing resolution. The numbers (1) to (8) or (1) to (16) at the pixel positions represent printing pass numbers for the discharge of ink droplets to the respective pixel positions. Thus, a highly glossy print result was obtained from the metallic ink under any one of these conditions.

Earlier, preferable conditions in various aspects for the metallic ink printing were mostly discussed. In practice, printing conditions for the color printing inks should also be fully considered as well as the printing conditions for the metallic ink. In the printing device 10 described referring to FIG. 1A, FIG. 1B, FIG. 2A and FIG. 2B, the color ink heads 202 and the metallic ink head 204 (see FIG. 2A and FIG. 2B) are desirably controlled in accordance with printing conditions preferably set for the color printing inks and the metallic ink.

For example, the printing conditions may be differently set for the color printing inks and the metallic ink. Examples of the printing conditions for the color printing inks and the metallic ink are hereinafter described in further detail.

Figure 15A:
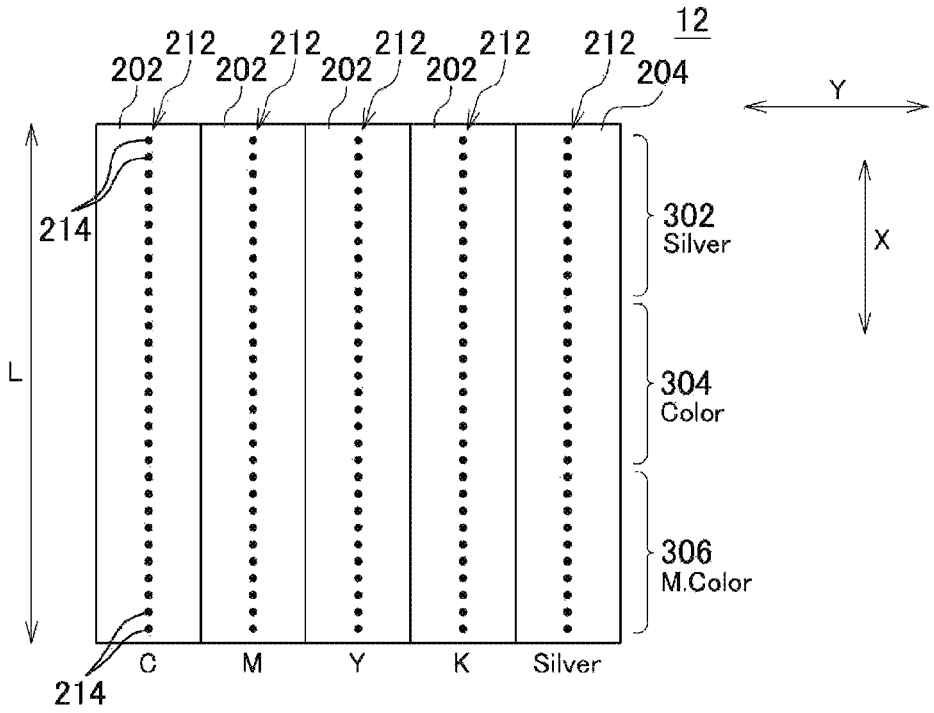
FIG. 15A and FIG. 15B are drawings illustrating a printing operation using the head unit 12.
Figure 15B:
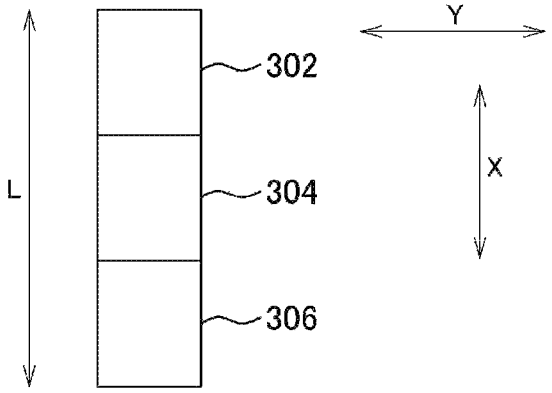

FIG. 15A and FIG. 15B are drawings illustrating the printing operation using the head unit 12. FIG. 15A is a drawing of exemplified specific features of the head unit 12. Except for the points hereinafter described, the head unit 12 illustrated in FIG. 15A is identical or similar to the head unit 12 described in connection with FIG. 1A to FIG. 14. For example, the physical aspects of the head unit 12 are identical or similar to those of the head unit 12 illustrated in FIG. 2A. The head unit 12 is used in, for example, in the printing device 10 illustrated in FIG. 1A and FIG. 1B. To expedite the description, the printing device and other technical aspects using the head unit 12 illustrated in FIG. 15A are hereinafter collectively referred to as the present example.

In the present example, the head unit 12 has a plurality of color ink heads 202 and a metallic ink head 204. In the present example, the color ink heads 202 and the metallic ink head 204 may be identically configured ink jet heads. These ink jet heads are arranged in the main scanning direction (Y direction) in positional alignment with one another in the sub scanning direction (X direction). In the present example, the metallic ink used in the metallic ink head 204 is a silver color metallic ink.

Though not illustrated in FIG. 2A and FIG. 2B, the ink jet heads of the head unit 12 each have a nozzle array 212 having a plurality of nozzles 214 aligned in a row in the sub scanning direction, as illustrated in FIG. 15A. The nozzles 214 of the color ink heads 202 are each an example of the color printing nozzle that discharges the ink droplets of the color printing ink. The nozzle 214 of the metallic ink head 204 is an example of the glossy ink nozzle that discharges the ink droplets of the glossy ink.

In the present example, the printing device 10 prints an object in multiple passes based on the mask data using the color ink heads 202 and the metallic ink head 204. In the multipass printing, the nozzle arrays 212 of the ink jet heads are divided by a plurality of regions.

In the illustrated example, the nozzles 214 of the ink jet heads are divided by three regions in the sub scanning direction; a metallic region 302, a color region 304, and a metallic-color region 306. The metallic region 302 is a region to be printed with the metallic ink. The color region 304 and the metallic-color region 306 are regions to be printed with the color printing inks.

In each main scan, the metallic ink head 204 discharges the ink droplets through the nozzles 214 of the nozzle array 212 included in the metallic region 302. The other nozzles 214 of the metallic ink head 204 not included in the metallic region 302 but are included in the color region 304 and the metallic-color region 306 are configured as non-discharge nozzles through which the ink droplets are not discharged.

From the color ink heads 202, the ink droplets are discharged through the nozzles 214 of the nozzle arrays 212 included in the color region 304 and the metallic-color region 306. The other nozzles 214 of the color ink heads 202 included in the metallic region are configured as non-discharge nozzles through which the ink droplets are not discharged.

The nozzles 214 included in the respective regions may refer to nozzles 214 having their positions overlapping with ranges of the respective regions in the sub scanning direction. In the present example, the color region 304 and the metallic-color region 306 are set as regions to be printed with the color printing inks. The color region 304 is a normal color printing region. In this instance, the normal color printing may refer to color printing applied to positions with no overlap with the metallic ink. The metallic-color region 306 is a region to be printed with the color printing inks with an overlap with the metallic ink to impart glossiness to the region (metallic color printing).

The color region 304 and the metallic-color region 306 may be regions for color printing using different profiles. The profile may specifically include items to be set to express various colors by mixing the process colors, C, M, Y, and K colors. Then, profiles suitable for the purpose of and conditions for printing may be set for the color region 304 and the metallic-color region 306, respectively.

The head unit 12 in a modified example may have a plurality of color ink heads 202 for use in the metallic-color region 306, in addition to the color ink heads 202 for use in the color region 304. The printing operation using the head unit 12 of the present example will be described in later in further detail.

FIG. 15B is a schematic drawing of the head unit 12. In the present example, the nozzle arrays 212 of the respective ink jet heads are divided by a plurality of regions. As in the drawing, the head unit 12 can be illustrated in a simplified manner by way of the divided regions.

It is illustrated in FIG. 15B that the nozzles arrays 212 of the ink jet heads of the head unit 12 are divided by three regions; metallic region 302, color region 304, and metallic-color region 306. Referring to the drawing, a distance L represents the length of the nozzle array 212 in the sub scanning direction.

To simplify the illustration of the head unit 12, FIG. 15A and FIG. 15B only show the C, M, Y, and K color ink jet heads as the color ink heads 202. The head unit 12 may have other color ink heads 202; ink jet heads for any colors but the C, M, Y, and K colors. For example, the head unit 12 may further have color ink heads 202 for light cyan (Lc); lightened C color, and light magenta (Lm); lightened M color.

FIG. 15A and FIG. 15B simply illustrate three equally divided regions for the nozzle arrays 212 of the ink jet heads. In this instance, the metallic region 302, color region 304, and metallic-color region 306 each have the length of L/3 in the main scanning direction.

In practical applications, the nozzle arrays 212 may be divided by more regions, or the regions may differ in length in the sub scanning direction. This is hereinafter described in further detail.

To start with, variation of the number of regions is described below. FIG. 16A through FIG. 16C are drawings illustrating the nozzle array division in further detail. FIG. 16A is a table showing exemplified numbers of regions for the nozzle array division (hereinafter, head division number). In the present example, the printing device 10 (see FIG. 1A and FIG. 1B) receives from a user a print request indicating the head division number. Specifically, the printing device 10, for example, receives an instruction indicating a level (Lv1 to Lv8) associated with the head division number. As prompted by the instruction, the printing device 10 divides the nozzle arrays according to the head division number indicated by the level.

In the multipass printing, the printing pass reduces in width as the head division number increases in so far as any other conditions are set likewise. In the present example, therefore, the printing pass reduces in width with a higher level.

FIG. 16B is a drawing of an exemplified region setting when the head division number is 5, In the illustrated example, the nozzle arrays of the ink jet heads are divided by the metallic region 302, color region 304, metallic-color region 306, and two other non-discharge regions 308. The non-discharge regions 308 receive the ink droplets from none of the color ink heads 202 or the metallic ink head 204.

One of the two non-discharge regions 308 is interposed between the metallic region 302 and the color region 304, and the other one is interposed between the color region 304 an the metallic-color region 306. The regions for the nozzle array division are arranged from one side in the sub scanning direction in the mentioned order below; metallic region 302, non-discharge region 308, color region 304, non-discharge region 308, and metallic-color region 306.

In the multipass printing, the head unit 12 repeatedly performs the main scans and performs the sub scans at intervals between the main scans. In the sub scans, the head unit 12 is moved relative to the medium in the sub scanning direction by a distance decided in accordance with the printing pass number and the manner of nozzle array division. The regions by which the nozzle arrays are divided, starting with one of the regions on one end side of the nozzle arrays in the sub scanning direction, overlap with the non-discharge regions 308 at positions on the medium. While these regions are overlapping with the non-discharge regions 308 at positions on the medium, the ink droplets are not discharged. Therefore, drying time for the ink may be more adequately secured by setting the non-discharge regions 308.

In the present example, the metallic region 302 and the metallic-color region 306 are set to carry out the metallic color printing, as described earlier. FIG. 16C shows an exemplified ink layer formed by the metallic color printing. The metallic color printing starts with discharging the ink droplets to a print region through the nozzles of the metallic ink head 204 (see FIG. 15A and FIG. 15B) included in the metallic region 302 to form a metallic layer 402 made of the metallic ink. After that, the main scans are performed a certain number of times decided based on the printing pass number. Then, the ink droplets are discharged onto the metallic layer 402 through the nozzles of the color ink heads 202 (see FIG. 15A and FIG. 15B) included in the metallic-color region 306 to form a color ink layer 404 made of the color printing inks on the metallic layer 402. The metallic color printing may be accordingly carried out in a suitable manner.

After the metallic layer 402 is formed, the non-discharge regions 308 may serve to save enough time to dry the metallic layer 402 by the time when the color ink layer 404 is formed. The metallic color printing may be accordingly carried out in a more suitable manner.

Specifics of the region setting for the nozzle arrays may not necessarily be configured as described so far, and may have various options. Some of such options may allow the glossy ink to attain better glossiness without compromising a desirable image quality to be achieved by the color printing ink. Hereinafter, various ways of setting regions for the nozzle arrays are described in relation to the printing operation using the head unit 12 of the present example.

Figure 17:
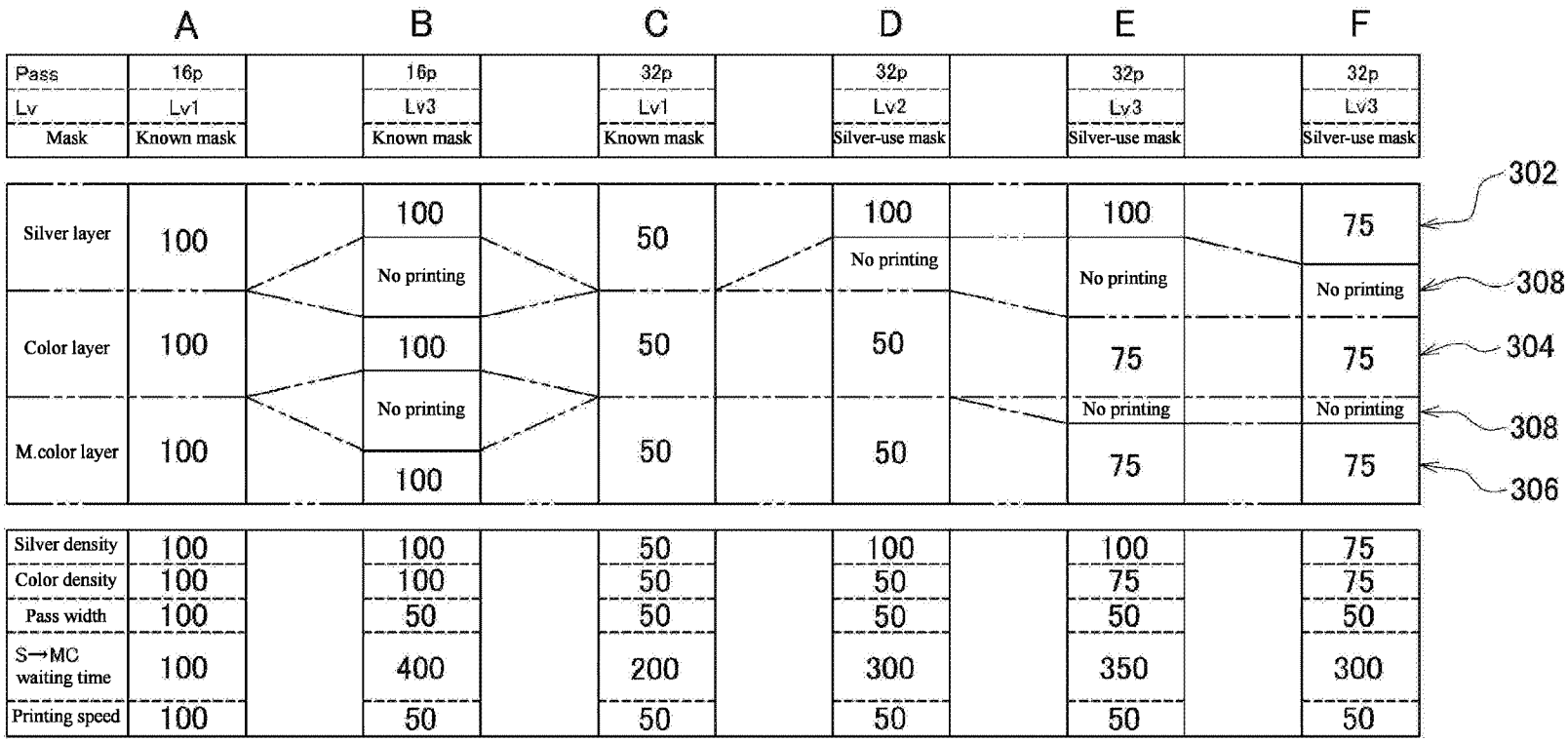
FIG. 17 is a drawing of an exemplified region setting for nozzle arrays of the head unit 12.

FIG. 17 is a drawing of an exemplified region setting for nozzle arrays of the head unit 12. FIG. 17 illustrate six ways of region setting illustrated with reference signs A to F (hereinafter, settings A to F). The printing resolution is set to 720×1440 dpi when the regions are set as illustrated in any one of the examples illustrated in the drawing.

The printing device 10 (see FIG. 1A and FIG. 1B) carries out the multipass printing under any one of the conditions illustrated in the drawing. Depending on the printing conditions, the main scan driver 14 (see FIG. 1A and FIG. 1B), in each one of the main scans, prompts the ink jet heads of the head unit 12 to discharge the ink droplets through their nozzles. The printing device 10 carries out the metallic color printing for at least a partial region by forming a color ink layer on the silver ink-made metallic layer.

The printing conditions may specifically include the printing pass number (pass), head division number (Lv), and mask data used (mask). In the example illustrated in FIG. 17, the printing pass number is set to 16 or 32. One of the levels in FIG. 16A is set as the head division number depending on the number of divided regions.

The mask data used is one selected from the known mask and silver-use mask illustrated in the drawing. The settings using the known mask may be employed for the multipass printing using mask data conventionally used. In the present example, when any one of the settings using the known mask is set, the same mask data is used for all of the metallic region 302, color region 304, and metallic-color region 306.

The silver-use mask is mask data particularly suitable for the metallic ink printing. In the present example, when any one of the settings using the silver-use mask is set, a piece of mask data is used for the metallic region 302, and a different piece of mask data is used for the color region 304 and the metallic-color region 306.

The piece of mask data used for the metallic region 302 may be applied to the nozzles of the metallic ink head 204 included in the metallic region 302. The piece of mask data used for the color region 304 and the metallic-color region 306 may be applied to the nozzles of the color ink heads 202 included in the color region 304 and the metallic-color region 306. The settings using the silver-use mask, including the setting D, will be described later in further detail.

In FIG. 17 are illustrated, below the print setting, different levels for region setting in the settings A to F, similarly to the illustration of FIG. 15B. In rectangular boxes indicating the regions are illustrated values of the main scan dot density for the nozzles in the respective regions relative to a reference density. As the reference density of the main scan dot density is used the density 100 of the setting A for 16-pass printing using the known mask.

The main scan dot density may refer to the density of ink dots formed on the medium by one nozzle in a preset number of main scans. The main scan dot density may be rephrased as the density of target pixels for the discharge of ink droplets in a predetermined number of main scans.

The density of target pixels for the discharge of ink droplets may represent a ratio of target pixels for the discharge of ink droplets in the main scans to pixels arranged suitably set for a demanded printing resolution. The density of target pixels for the discharge of ink droplets may be more specifically a ratio of target pixels for the discharge of ink droplets to pixels included in a certain area. The density of target pixels for the discharge of ink droplets may be rephrased as a recording duty or a recording density by a predetermined number of main scans. The main scan dot density may be more specifically an ink dot density in one main scan. The main scan dot density may be an ink dot density in a preset number of main scans.

FIG. 17 further show, below the region setting, values of the following condition items relative to 100 in the setting A; silver ink density (silver density), color printing ink density (color density), printing pass width (pass width), waiting time for the metallic color printing (S→MC waiting time), and printing speed. The silver ink density is the main scan dot density for the nozzles of the metallic ink head 204 included in the metallic region 302. The color printing ink density is the main scan dot density for the nozzles of the color ink heads 202 included in color region 304 and the metallic-color region 306.

The printing pass width is the width of a region printed in one printing pass in the sub scanning direction. The waiting time for the metallic color printing is a period of time before the color ink layer starts to be formed after the metallic layer is formed in a region to be printed in the metallic color. The printing speed is the printing speed of the printing device 10 that depend on which one of the settings A to F is selected.

The settings A to F are hereinafter described in further detail. Among the settings illustrated in FIG. 17, the setting A is similar to the setting illustrated in FIG. 15B, in which the metallic region 302, color region 304, and metallic-color region 306 are set in an equal width for the nozzle arrays of the ink jet heads. The width of the region here means the length of the region in the sub scanning direction. The mask data used in the setting A is the known mask. In the setting A, the nozzles of the color ink heads 202 and the metallic ink head 204 form the ink dots at an equal main scan dot density on the medium.

The setting A, according to the region setting of the level Lv1 illustrated in FIG. 16A, sets the metallic region 302, color region 304, and metallic-color region 306. The printing operation starts with multipass printing with the printing pass number of 16. Specifically, the silver color ink is discharged to positions on the medium through the nozzles of the metallic ink head 204 included in the metallic region 302. As a result, the metallic layer is formed on the medium. Then, the inks are discharged through the nozzles of the color ink heads 202 included in the color region 304 to form a color ink layer in any parts on the medium not overlapping with the metallic layer. Then, the inks are discharged through the nozzles of the color ink heads 202 included in the metallic-color region 306 to form a color ink layer on the metallic layer.

In this manner, the printing using the color printing inks and the metallic ink may be performed well, and the metallic color printing that overlaps the color printing inks on the metallic ink may be performed well.

The setting B is employed to further set the non-discharge regions 308. The setting B differs from the setting A in that the non-discharge regions 308 are interposed between the metallic region 302 and the color region 304, and between the color region 304 and the metallic-color region 306. Accordingly, an object may be favorably printed with the color printing inks and the metallic ink by setting the metallic region 302, color region 304, and metallic-color region 306.

This setting, by further setting the non-discharge regions 308, may prolong the waiting time for the metallic color printing as compared to the setting A. Accordingly, the metallic layer may be fully dried before the color ink layer is formed thereon, and the metallic color printing may present a favorable print result.

The setting C has a smaller main scan dot density than the setting A. The setting C is different from the setting A in that the main scan dot density for each region is reduced to a half of the main scan dot density in the setting A, as illustrated in the drawing, and the printing pass number is accordingly doubled to 32. In this setting, an object may be favorably printed with the color printing inks and the metallic ink by setting the metallic region 302, color region 304, and metallic-color region 306.

This setting, with a greater pass number, may further prolong the waiting time for the metallic color printing as compared to the setting A. As a result, the metallic layer may be fully dried before the color ink layer is formed thereon, and the metallic color printing may present a more favorable print result.

By setting any one selected from the settings A to C, an object may be favorably printed with the color printing inks and the metallic ink. A illustrated in the drawing, the settings A to C use the known mask data for all of the metallic region 302, color region 304, and metallic-color region 306 to apply the metallic ink and the color printing inks under the same printing conditions. In some cases, however, it may be difficult to satisfy suitable conditions for both of the metallic ink and the color printing inks. To be more specific, it may be difficult to attain excellent glossiness of the glossy ink while preventing the occurrence of color bleeding between the color printing inks.

In the settings D to F, the silver-use mask is used instead of the known mask data. These settings, therefore, may successfully provide conditions suitable for both of the metallic ink and the color printing inks. In this instance, the main scan dot density for the nozzles of the metallic ink head 204 and the main scan dot density for the nozzles of the color ink heads 202 may be effected to differ by using different pieces of mask data for the nozzles of the metallic ink head 204 and the nozzles of the color ink heads 202.

Of the settings D to F in FIG. 17, the head division number is Lv2 in the setting D, and Lv3 in the settings E and F. The larger levels (for example, Lv4) with larger head division numbers may instead be used. Except for the points so far and hereinafter described, the settings D to F may be identical or similar to the settings A to C.

The settings D to F are hereinafter described in further detail. The description starts with the settings D and E. In the settings D and E, smaller values of the density are set for the color printing inks than the silver ink. In the setting D, the main scan dot density is set for the nozzles in each region, so that the silver ink has the density of 100, and the color printing inks have the density of 50. In the setting E, the main scan dot density is set for the nozzles in each region, so that the silver ink has the density of 100, and the color printing inks have the density of 75.

The other conditions including the printing pass number may be set in accordance with the main scan dot density for the nozzles in each region. In contrast to the setting A, for example, the non-discharge regions 308 are appropriately set in accordance with different widths of the regions. In the setting D, the non-discharge region 308 is interposed between the metallic region 302 and the color region 304. In the setting E, the non-discharge region 308 is further interposed between the color region 304 and the metallic-color region 306. The level of the head division number is decided in accordance with the number of divided regions.

Accordingly, the silver color ink dots may be formed at a higher main scan dot density. This may facilitate the setting of requirements that allow for contact between the ink dots on the medium. A lower main scan dot density is set to form the color printing ink dots. This may facilitate the setting of requirements that allow for no contact between the ink dots on the medium. As for the silver ink density, the main scan dot density may preferably be regulated to allow for contact between any ones of the dots on the medium. As for the color printing ink density, the main scan dot density may preferably be regulated to allow for no contact between any ones of the dots on the medium.

This may effectively prevent color bleeding between the color printing inks, while successfully attaining high glossiness of the glossy ink. Further favorably, the glossy ink may attain even higher glossiness without compromising a desirable image quality to be achieved by the color printing ink.

During the metallic color printing, for example, the ink droplets of another ink (color printing ink) are discharged onto the metallic layer. In the case where the ink droplets are discharged in an overly abundant volume at a time at the main scan dot density relatively high, the metallic ink may possibly be tainted with the ink discharged later. This may result in a poor printing quality.

In the settings D and E, the color printing inks are less likely to penetrate into the metallic ink by setting a lower main scan dot intensity for the color printing inks, preventing the printing quality from degrading.

The setting E, by increasing the total width of the non-discharge regions 308, may further prolong the waiting time for the metallic color printing as compared to the setting D. This may allow the metallic layer to be fully dried before the color ink layer is formed thereon. The metallic color printing may be accordingly carried out in a more suitable manner.

The features of the settings D and E may be defined such that the nozzles of the metallic ink head 204 form the ink dots at a first main scan dot density, and the nozzles of the color ink heads 202 form the ink dots at a second main scan dot density lower than the first main scan dot density. Thus, the main scan dot density may be favorably set for the nozzles of the metallic ink head 204 and the color ink heads 202, respectively.

The features of the settings D and E may be further defined as follows. When a printing pass number required for solid-color print of a preset region at a preset concentration is referred to as a solid print pass number, mask data used for the nozzles of the metallic ink head 204 and the color ink heads 202 is configured to set a smaller solid print pass number when the nozzles of the metallic ink head 204 are used for solid-color print than the solid print pass number when the nozzles of the color ink heads 202 are used for solid print. Accordingly, the ink dots may be favorably formed by the nozzles of the metallic ink head 204 and the color ink heads 202 based on the printing pass numbers respectively suitable for the first main scan dot density and the second main scan dot density.

As described earlier, when the metallic ink having, for example, a silver color is used, an adequately high glossiness may not be attained unless the ink droplets are discharged at a certain density or above. Therefore, at least a certain volume or even a greater volume of ink droplets (printing density) are desirably ejected. The required volume of ink droplets to be ejected may change with the printing pass numbers. Specifically, a required volume of ink droplets increases with greater printing pass numbers. Further, a greater ink volume dropping at a time per unit area may be likely to improve the brightness of the metallic ink.

The metallic ink printing may likely to degrade the brightness unless adequate drying time is invested. Another requirement is the printing pass number large enough to prevent streaks from appearing. Otherwise, the image quality may be degraded. The metallic color printing, in particular, may degrade the brightness unless the waiting time for the metallic color printing and drying time are long enough. Another point to be considered in the metallic color printing is the volume of the color printing inks to be discharged (printing volume). The color printing inks discharged in excess may degrade the brightness.

As described earlier, the settings D and E may adequately increase the volume of ink droplets to be ejected by forming the dots of the metallic ink (silver color ink) at a higher main scan dot density. These conditions may ensure adequately long waiting time for the metallic color printing and drying time. These conditions may also adequately increase the main scan dot density of the metallic ink, ensuring high brightness with a small ink volume, and prevent that the ink droplets of the color printing inks are discharged in excess at a time on the metallic layer. Therefore, an object may be more favorably printed with the color printing inks and the metallic ink.

In the settings of FIG. 17, the metallic ink dots and the color printing ink dots may have an equal size. When a plurality of ink layers are stacked on each other as in the metallic color printing, the ink dots constituting the upper color ink layer may have a smaller size than the ink dots constituting the lower metallic layer. This may effectively prevent the color printing inks from penetrating into the metallic ink. Accordingly, the color printing inks and the metallic ink may be carried out in a more suitable manner even at a high printing resolution.

In the respective settings (settings A to E), an equal main scan dot density is set for the nozzles within the same region. In any other conditions, the ink dots may be formed by a part of the nozzles within a region at a main scan dot density that differs from the main scan dot density for the other nozzles within the region.

The setting F differs from the other settings in that the main scan dot density is changed for a part of the nozzles of the metallic ink head 204 included in the metallic region 302. In this instance, the main scan dot density may be lowered for an end nozzle(s) among the nozzles of the metallic ink head 204 included in the metallic region 302. Specifically, the ink dots are formed at the first main scan dot density by one of the nozzles in the middle among the nozzles of the metallic ink head 204 included in the metallic region 302, while the ink dots are formed at a third main scan dot density lower than the first main scan dot density by at least one of the nozzles on one end among the nozzles.

Accordingly, a lower main scan dot density may be set for the boundary between target regions to be printed with the metallic ink in the respective main scans. By setting the lower main scan dot density at the boundary, the boundary may be less conspicuous, effectively suppressing the occurrence of banding. This may accordingly attain excellent glossiness, while suppressing the occurrence of banding. As a result, the color printing inks and the metallic ink may be applied for printing in a more suitable manner.

The setting F differs from the setting E in that the main scan dot density may be lowered for the nozzles of the metallic ink head 204 included in the metallic region 302. In this instance, the silver ink density illustrated in the drawing may be an average main scan dot taken from all of the nozzles of the metallic ink head 204 included in the metallic region 302.

As described earlier in connection with FIG. 1A and FIG. 1B, the printing device 10 in the present example prompts the head unit 12 to perform the sub scans by transporting the medium. At least one end in the row of nozzles may be at least one end on the upstream or downstream side in the transport direction of the medium. In this instance, the main scan dot density for the nozzles on both ends in the row of nozzles may preferably be smaller than the main scan dot density for the nozzle in the middle of the row.

The settings described so far are non-limiting examples of the region setting for the nozzle arrays. Other optional settings may also be applicable. In contrast to the settings described earlier, the non-discharge regions 308 may be omitted. In the case of using inks very quick to dry, demanding less drying time, the non-discharge regions 308 may be excluded from the setting E. In contrast the setting E, the color region 304 may be accordingly expanded to cover the non-discharge regions 308 currently provided. In the setting E, all of regions including the color region 304 and two non-discharge regions 308 are collectively used as the color region 304. This saves a larger area for the color region 304, leading to a higher color printing quality.

A further modified embodiment is hereinafter described. The head unit 12, instead of the structural features of FIG. 2A and FIG. 15A described so far, may be variously modified.

In the head units 12 illustrated in FIG. 2A and FIG. 15A, for example, the metallic ink nozzle array and the color printing nozzle arrays are respectively formed in different ink jet heads. In the further modified embodiment of the head unit 12, the metallic ink nozzle array and the color printing nozzle arrays may be formed in one ink jet head.

As mentioned earlier, the head unit 12 may further have color ink heads 202 for light cyan (Lc) and light magenta (Lm) in addition to the ink jet heads for the C, M, Y, and K colors. When, for example, the conventional color printing is carried out in a region apart from the region of the metallic layer, the color ink heads 202 for light cyan and light magenta may be additionally used. In this manner, the conventional color printing may be carried out with a higher quality.

The printing device, to color-print the metallic layer for the metallic color printing, may use the C, M, Y, and K color ink heads 202 alone, without having to use the color ink heads 202 for light cyan and light magenta. In this manner, the metallic color printing may be more appropriately carried out.

The metallic ink discharged may land on any kind of layer, instead of landing on the medium. For the metallic color printing, the metallic layer may be formed on the color ink layer. The positions of the metallic region 302, color region 304, and metallic-color region 306 may be suitably changed depending on which one of the layers is formed on or below the other.

Earlier, how to maximize the glossiness of the metallic ink was described with a focus being placed on sufficient time for orientation of the pigment in the metallic ink. To maximize the glossiness of the metallic ink, it may be more desirable to fully flatten metallic ink layer to improve in glossiness. In this perspective, the present example may easily flatten the ink dots by facilitating contact therebetween. The present example, in this regard as well as other merits, may attain even higher glossiness of the metallic ink.

To flatten the ink dots by facilitating contact therebetween, the metallic ink may not necessarily be limited to an ink that requires drying (for example, solvent ink) but may be selected from inks that can be fixated without drying. Examples of such inks may include ultraviolet curing-type inks (UV inks) curable by being irradiated with ultraviolet light. Such inks may be flattened in less time by bringing the ink dots into mutual contact. Each dot of such an ultraviolet curing-type ink may soon become too matte to be spreadable. When, however, the ink dots are adequately flattened before curing starts, an ink layer formed may improve in glossiness.

In this instance, a liquid component contained in the uncured ink may be the solvent of the ink. A monomer, for example, contained in the ultraviolet curing-type ink may be the solvent of the ink.

Focusing on flatness of the ink layer, any one of the described settings may not only be applicable to the metallic ink but also be applicable to an ink for solid-color print of a preset region (hereinafter, solid-color print ink). The solid-color print of a preset region may be rephrased as discharging the ink droplets at a concentration preset in the printing device (for example, 100% concentration). The preset concentration may be a concentration at which the ink droplets are discharged to all of pixel positions that are set suitably for a demanded printing resolution.

Specific examples of the solid-color print ink may include, in addition to the metallic ink, inks for overcoating such as translucent clear inks and inks having a predetermined color (for example, white) used to print the substrate. Any one of such solid-color print inks may desirably be discharged at a sufficiently high main scan dot density. Specifically, the main scan dot density may preferably be regulated to allow for contact on the medium between any ones of the dots and any other ones of the dots in liquid state that are formed in the respective main scans. By allowing for contact between the liquid ink dots, the ink dots may soon lose their original shapes and become adequately flat. This may ensure that a certain region is more uniformly solid-color printed with the ink. Further, a glossy printed matter may be printed by thus adequately flattening the ink layer.

In this instance, a lower main scan dot density may be set for the color printing inks used for image printing than the solid-color print ink. This may effectively prevent color bleeding between the color printing inks.

This feature may be defined such that the solid print nozzles, through which ink droplets of the solid-color print ink are discharged to solid-color print a preset region, form the ink dots at the first main scan dot density, and the color printing nozzles form the ink dots at the second main scan dot density lower than the first main scan dot density. Thus, the main scan dot density may be favorably set for the solid-color print ink and the color printing inks, respectively. Further favorably, any target region may be adequately solid-color printed with the solid-color print ink without compromising a desirable image quality to be achieved by the color printing ink.

The solid print nozzles may form an ink layer overlapping with the color printing ink layer. When a clear ink is used as the solid-color print ink, a clear ink layer may be formed on the color printing ink layer. The solid print nozzles may form a solid-color print ink layer below the color printing ink layer. In the metallic color printing, the metallic layer may be formed below the color printing ink layer.

Figures 18A, 18B:
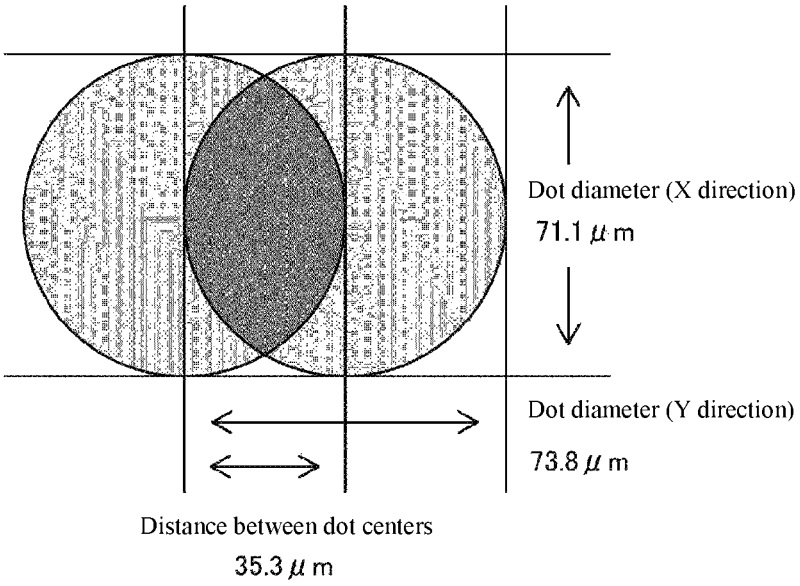
FIG. 18A and FIG. 18B are drawings illustrating the metallic ink printing.

Hereinafter, technical effects are additionally described that are produced by using the metallic ink for printing. FIG. 18A and FIG. 18B are drawings illustrating the metallic ink printing. FIG. 18A is a drawing of an exemplified overlap between metallic ink dots. FIG. 18B is a table showing exemplified properties of the metallic ink used. To expedite the description, the technical aspects described referring to FIG. 1A to FIG. 17 are hereinafter collectively referred to as the present example.

As described referring mostly to FIG. 1A to FIG. 14, when the metallic ink is used for printing, excellent glossiness may be attained by adequately reducing the dot intervals. This may improve the pigment orientation. When a pigment containing smaller particles is used, therefore, adequately high glossiness may be obtained. Assuming that a metallic ink containing a pigment including fine aluminum particles is used, adequately high glossiness may be likewise obtained when an average particles size of the particles is 0.5 μm or less (for example, approximately 0.1 to 0.5 μm, preferably, 0.2 to 0.5 μm).

When the ink droplets of the metallic ink are discharged from the ink jet head, large pigment particles may often clog the nozzles, leading to the ink discharge failure. The present example, on the other hand, may effectively attain high glossiness of the metallic ink containing smaller pigment particles, improving usefulness of the metallic ink in the ink jet heads.

Suitable examples of the metallic ink (solvent metallic ink) in the present example may include inks containing colorants (aluminum), solvents, binders, and additives. Breaking down the composition of such a metallic ink that amounts in total to 100 % by weight, for example, the metallic ink contains 4 % by weight of a colorant (aluminum), contains 56 % by weight of BGA (butyl glycol acetate), 18 % by weight of GBL (γ-butyrolactone), and 18 % by weight of PMA (propylene glycol monomethyl acetate) as solvents, and further contains 2 % by weight of SOLBIN C5 R supplied by Nissin Chemical Industry Co., Ltd., as a binder, and 2 % by weight of an additive.

As described referring to FIG. 4 and FIG. 5, too large dot intervals on the medium may markedly degrade the glossiness of the metallic ink. In the present example, contact is effected between the metallic ink dots on the medium to have the ink dots overlap with one another to a certain extent. This may secure sufficiently long time before the ink dots are dried, allowing the pigment particles to be orderly aligned (oriented). The present example may improve the brightness, achieving excellent glossiness.

However, a better result is not always obtained by a smaller dot interval. The dot intervals reduced in size beyond a certain extent may promise relatively high glossiness, while resulting in a lower glossiness than its peak value. In order to most effectively obtain higher glossiness, the inter-dot overlap may desirably stay within a certain range of values.

To this end, the inter-dot distance may preferably be decided so as to have the inter-dot overlap equal to approximately a half of the dot diameter. More specifically describing the inter-dot distance by way of the test conditions described referring to FIG. 4 and FIG. 5, approximately 35.3 μm may be an optimal value as the inter-dot distance when the dot diameter is approximately 72 μm, as illustrated in FIG. 18A. Accordingly, the inter-dot overlap may be approximately 50% of the dot diameter and approximately 30% of the area of one dot. The metallic ink used then may be a metallic ink having properties shown in FIG. 18A.

More generalizing the described condition, the inter-dot overlap may preferably be approximately 50% (for example, between 40% and 60%) of the dot diameter in the case of any glossy inks (metallic inks) usable in the ink jet head. This may further ensure high glossiness.

Thus far were described the embodiments of this disclosure. However, the technical scope of this disclosure is not necessarily limited to the embodiments. It should be understood by those skilled in the art that the embodiments may be subject to various changes or improvements. As is clearly understood from the appended claims, such changes and improvements are naturally included in the technical scope of this disclosure.

INDUSTRIAL APPLICABILITY

This disclosure may be suitably applicable to printing devices.

The invention claimed is:

1. A printing device that prints an object on a medium by inkjet printing, the printing device comprising:

a glossy ink head as an inkjet head that discharges ink droplets of a glossy ink having a glossy color, the glossy ink containing a glossy pigment and a solvent, wherein the glossy pigment contains a light-reflecting pigment that includes scaly particles, and the glossy pigment is fixated to the medium by evaporating the solvent; and a main scan driver that prompts the glossy ink head to perform main scans in which the glossy ink head discharges the ink droplets while moving in a main scanning direction previously set, the glossy ink head, in the main scans, discharging the ink droplets plural times while moving in the main scanning direction to form ink dots at a plurality of positions on the medium aligned in the main scanning direction, the ink droplets discharged from the glossy ink head each having a volume constituting a size that allows for contact on the medium between any ones of the ink dots that are formed in each one of the main scans and in a state of ink dot of liquid on the medium and arranged in the main scanning direction before the solvent is volatilized and stripped from the ink dots on the medium.

2. The printing device according to claim 1, wherein the glossy ink is a metallic color ink.

3. The printing device according to claim 1, further comprising a color ink head as an inkjet head that discharges ink droplets of a color printing ink, wherein an ink dot formed on the medium by an ink droplet discharged from the color ink head is smaller in size than an ink dot formed on the medium by an ink droplet discharged from the glossy ink head.

4. The printing device according to claim 3, further comprising a drive signal output unit that outputs a drive signal to prompt the ink droplets to be discharged, wherein the drive signal output unit outputs a first drive signal to the color ink head, the first drive signal being a signal that changes in a first waveform previously set, and the drive signal output unit further outputs a second drive signal to the glossy ink head, the second drive signal being a signal that changes in a waveform different from the first waveform of the first drive signal.

5. The printing device according to claim 3, wherein the glossy ink is more readily spreadable on the medium than the color printing ink.

6. The printing device according to claim 1, wherein the printing device prints an object by multipass printing the glossy ink head, in each one of the main scans, discharges the ink droplets to pixel positions selected based on mask data previously defined and set, and the ink droplets discharged from the glossy ink head each have a volume constituting a size that allows for contact on the medium between the ink dots formed in each one of the main scans.

7. The printing device according to claim 6, further comprising another color ink head as an inkjet head that discharges ink droplets of a color printing ink, wherein the color ink head discharges the ink droplets to pixel positions selected based on one piece of the mask data shared with the glossy ink head, and the ink droplets discharged from the color ink head each have a volume constituting a size that allows for no contact on the medium between the ink dots formed in each one of the main scans.

8. The printing device according to claim 1, wherein the glossy ink head comprises a glossy ink nozzle through which the ink droplets of the glossy ink are discharged, the printing device comprises a color printing nozzle through which the ink droplets of the color printing ink are discharged, the main scan driver prompts the glossy ink nozzle and the color printing nozzle to discharge the ink droplets in the main scans, and when a density of the ink dots formed on the medium by one nozzle in a preset number of the main scans is defined as a main scan dot density, the main scan driver prompts the glossy ink nozzle to form the ink dots at a first main scan dot density and prompts the color printing nozzle to form the ink dots at a second main scan dot density lower than the first main scan dot density.

9. The printing device according to claim 8, wherein the first main scan dot density is a main scan dot density that allows for contact on the medium between any ones of the ink dots of the glossy ink, and the second main scan dot density is a main scan dot density that allows for no contact on the medium between any ones of the ink dots of the color printing ink.

10. The printing device according to claim 8, wherein the printing device prints an object by multipass printing based on mask data that designates target pixels for which the ink droplets are discharged in each one of the main scans, and the main scan driver uses different pieces of the mask data respectively for the glossy ink nozzle and for the color printing nozzle so as to have the first main scan dot density and the second main scan dot density differ from each other.

11. The printing device according to claim 10, wherein when a printing pass number required for solid-color print of a preset region at a preset concentration is defined as a solid-color print pass number, the main scan driver uses mask data for the glossy ink nozzle and the color printing nozzle, the mask data being configured to set a smaller value for the solid-color print pass number when the solid-color print is performed by the glossy ink nozzle than for the solid-color print pass number when the solid-color print is performed by the color printing nozzle.

12. The printing device according to claim 8, further comprising a sub scan driver that prompts the glossy ink head to perform sub scans in which the glossy ink head moves relative to the medium in a sub scanning direction orthogonal to the main scanning direction, the glossy ink head comprising a plurality of the glossy ink nozzles aligned in a row in the sub scanning direction wherein the main scan driver prompts at least a middle one in the row of the glossy ink nozzles to form the ink dots at the first main scan dot density, and the main scan driver prompts at least an endmost one in the row of the glossy ink nozzles to form the ink dots at a third main scan dot density lower than the first main scan dot density.

13. The printing device according to claim 8, wherein the color printing nozzle discharges the ink droplets on an ink layer formed by the glossy ink nozzle.

14. A printing method of printing an object on a medium by inkjet printing, the printing method comprising:

prompting a glossy ink head as an inkjet head that discharges ink droplets of a glossy ink having a glossy color to perform main scans in which the glossy ink head discharges the ink droplets while moving in a main scanning direction previously set, the glossy ink comprising a glossy pigment and a solvent, wherein the glossy pigment contains a light-reflecting pigment that includes scaly particles, and the glossy pigment is fixated to the medium by evaporating the solvent, the glossy ink head, in the main scans, discharging the ink droplets plural times while moving in the main scanning direction to form ink dots at a plurality of positions on the medium aligned in the main scanning direction, the ink droplets discharged from the glossy ink head each having a volume constituting a size that allows for contact on the medium between any ones of the ink dots that are formed in each one of the main scans and in a state of ink dot of liquid on the medium and arranged in the main scanning direction before the solvent is volatilized and stripped from the ink dots on the medium.

15. A printing device that prints an object on a medium by inkjet printing, the printing device comprising:

a glossy ink head as an ink jet head that discharges ink droplets of a glossy ink having a glossy color, wherein the glossy color contains a light-reflecting pigment that includes scaly particles, the glossy ink comprises a glossy pigment and a solvent, and the glossy pigment is fixated to the medium by evaporating the solvent; and a main scan driver that prompts the glossy ink head to perform main scans in which the glossy ink head discharges the ink droplets while moving in a predetermined main scanning direction, the glossy ink head having a glossy ink nozzle through which the ink droplets of the glossy ink are discharged, the main scan driver prompting the glossy ink nozzle to discharge the ink droplets in the main scans, with a density of ink dots formed on the medium by one nozzle in a preset number of the main scans being defined as a main scan dot density, the ink dots formed by the glossy ink nozzle having a main scan dot density that allows for contact on the medium between any ones of the dots and any other ones of the dots that are formed in each one of the main scans and in a state of ink dot of liquid on the medium and arranged in the predetermined main scanning direction before the solvent is volatilized and stripped from the ink dots on the medium.

* * * * *